US010513364B2

(12) United States Patent
Howell et al.

(10) Patent No.: US 10,513,364 B2
(45) Date of Patent: Dec. 24, 2019

(54) VARIABLE DISPLACEMENT CONTAINER BASE

(71) Applicant: GRAHAM PACKAGING COMPANY, L.P., Lancaster, PA (US)

(72) Inventors: Justin A. Howell, Mechanicsburg, PA (US); John E. Denner, York, PA (US); Shannon K. Sprenkle, York, PA (US); Robert Waltemyer, Felton, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 0 days.

(21) Appl. No.: 16/042,743

(22) Filed: Jul. 23, 2018

(65) Prior Publication Data

US 2018/0327133 A1 Nov. 15, 2018

Related U.S. Application Data

(63) Continuation-in-part of application No. 15/048,312, filed on Feb. 19, 2016, now Pat. No. 10,029,817, (Continued)

(51) Int. Cl.
*B65D 1/02* (2006.01)
*B65D 79/00* (2006.01)

(52) U.S. Cl.
CPC ..... *B65D 1/0276* (2013.01); *B65D 79/005* (2013.01)

(58) Field of Classification Search
None
See application file for complete search history.

(56) References Cited

U.S. PATENT DOCUMENTS 5,139,162 A 8/1992 Young et al.
6,585,123 B1 7/2003 Pedmo et al.
(Continued)

FOREIGN PATENT DOCUMENTS

CA 2 808 996 A1 3/2012
FR 2998877 A1 6/2014
(Continued)

OTHER PUBLICATIONS

U.S. Appl. No. 14/176,891, (U.S. Pat. No. 9,296,539), filed Feb. 10, 2014 (Mar. 29, 2016).
(Continued)

*Primary Examiner* — Jeffrey R Allen
*Assistant Examiner* — Jennifer Castriotta
(74) *Attorney, Agent, or Firm* — Baker Botts L.L.P.

(57) ABSTRACT

Base includes an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion, the intermediate surface including a linear portion and an intermediate radiused portion, a third radiused portion extending radially inward from the intermediate surface and convex relative to the reference plane, and a central portion disposed proximate the third radiused portion.

19 Claims, 35 Drawing Sheets

Related U.S. Application Data which is a continuation of application No. 14/176,891, filed on Feb. 10, 2014, now Pat. No. 9,296,539, which is a continuation of application No. PCT/US2014/011433, filed on Jan. 14, 2014.

(60) Provisional application No. 61/752,877, filed on Jan. 15, 2013, provisional application No. 61/838,166, filed on Jun. 21, 2013.

(56) References Cited

U.S. PATENT DOCUMENTS

| | | | |
|---|---|---|---|
| 2003/0221987 | A1 | 12/2003 | Trude |
| 2008/0047964 | A1 | 2/2008 | Denner et al. |
| 2009/0090728 | A1 | 4/2009 | Trude et al. |
| 2009/0159556 | A1 | 6/2009 | Patcheak et al. |
| 2009/0242575 | A1 | 10/2009 | Kamineni et al. |
| 2010/0219152 | A1 | 9/2010 | Derrien et al. |
| 2011/0049083 | A1 | 3/2011 | Scott et al. |
| 2012/0248060 | A1 | 10/2012 | Saito Hiromichi et al. |
| 2013/0001235 | A1 | 1/2013 | Patchheak et al. |
| 2015/0298848 | A1 | 10/2015 | Hermel |

FOREIGN PATENT DOCUMENTS

| | | | |
|---|---|---|---|
| JP | 2007 269392 | A | 10/2007 |
| JP | 2012/111546 | A | 6/2012 |
| WO | WO 2013/180032 | A1 | 12/2013 |

OTHER PUBLICATIONS

U.S. Appl. No. 15/048,312, (U.S. Pat. No. 10,029,817), filed Feb. 19, 2016 (Jul. 24, 2018).
U.S. Appl. No. 14/176,891, Feb. 18, 2016 Issue Fee Payment.
U.S. Appl. No. 14/176,891, Nov. 18, 2015 Notice of Allowance.
U.S. Appl. No. 14/176,891, Oct. 28, 2015 Applicant Initiated Interview Summary.
U.S. Appl. No. 14/176,891, Oct. 26, 2015 Response after Final Action.
U.S. Appl. No. 14/176,891, Jul. 24, 2015 Final Office Action.
U.S. Appl. No. 14/176,891, May 4, 2015 Response to Non-Final Office Action.
U.S. Appl. No. 14/176,891, Feb. 4, 2015 Non-Final Office Action.
U.S. Appl. No. 15/048,312, Jun. 22, 2018 Issue Fee Payment.
U.S. Appl. No. 15/048,312, Mar. 22, 2018 Notice of Allowance.
U.S. Appl. No. 15/048,312, Jan. 5, 2018 Response to Non-Final Office Action.
U.S. Appl. No. 15/048,312, Aug. 7, 2017 Non-Final Office Action.
International Search Report and Written Opinion for PCT/US2014/011433, dated May 13, 2014.
Supplementary European Search Report dated Sep. 16, 2016 in Application No. EP 14741125.

600

500

400

VARIABLE DISPLACEMENT CONTAINER BASE

CROSS-REFERENCE TO RELATED APPLICATIONS

This application is a continuation in part of continuation of U.S. patent application Ser. No. 15/048,312, filed on Feb. 19, 2016, which is a continuation of U.S. application Ser. No. 14/176,891, filed on Feb. 2, 2014, which is a continuation of International Application No. PCT/US14/11433, filed Jan. 14, 2014, which claims priority to U.S. Provisional Application No. 61/752,877, filed Jan. 15, 2013, and U.S. Provisional Application No. 61/838,166, filed Jun. 21, 2013, the disclosure of each of which is incorporated by reference herein in its entirety.

BACKGROUND

Plastic containers, used for filling with juices, sauces etc., often are hot filled and then cooled to room temperature or below for distribution to sell. During the process of hot filling and quenching, the container is subjected to different thermal and pressure scenarios that can cause deformation, which may make the container non-functional or visually unappealing. Typically, functional improvements are added to the container design to accommodate the different thermal effects and pressures (positive and negative) that can control, reduce or eliminate unwanted deformation, making the package both visually appealing and functional for downstream situations. Functional improvements can include typical industry standard items such as vacuum panels and bottle bases to achieve the desired results. However, it is often desirable that these functional improvements, such as vacuum panels, are minimal or hidden to achieve a specific shape, look or feel that is more appealing to the consumer. Additional requirements may also include the ability to make the container lighter in weight but maintain an equivalent level of functionality and performance through the entire hot fill and distribution process.

Existing or current technologies such as vacuum panels in the sidewall of the container may be unappealing from a look and feel perspective. Vacuum panels rely on different components to function efficiently and effectively. One of the components of the efficiency includes the area in which the deformation to internal positive or negative pressure is controlled and/or hidden. Technologies that include a vacuum panel in the base portion thus are restricted by surface area of the container. Because of this, the shape and surface geometry that define the bottle's appearance, along with the potential to make the bottle lighter, such as reducing material used, must be considered. In addition to surface area, another factor in the performance of a vacuum panel can be its thickness distribution. That is, material thickness can play a role in how the panel responds to both positive and negative internal pressure. Through surface geometry however, the effect of material distribution can be addressed to provide a functional panel that performs consistently as it is intended within a desired process window. For example, with the continued development of lighter weight containers with reduced sidewall thickness, it may be necessary to provide a surface geometry capable of controlled deformation at lower pressure differentials. Thus there is a continued need to develop a base with surface geometries that utilize the limited base area to address the inconsistencies that are presented during the blow process specific to material distribution and the varying dynamics the container will be exposed to through the product lifecycle, as well as to expand the limits of the containers shape and/or weight while maintaining the functionality needed to perform as intended.

Furthermore, an additional factor for consideration in designing a container for use in a hot-fill application is the rate of cooling. For example, a hot-fill container filled at 180° F. generally may need to be cooled to at least about 90° F. in about 12-16 minutes for commercial applications. Therefore, a need exists for a container that can accommodate different rates of cooling. Preferably, such a container is capable of accommodating both negative pressures relative to the atmosphere due to such cooling as well as positive pressures due to changes in altitude or the like, internal pressure exerted during the hot-fill and capping process, as well as flexing to retain overall bottle integrity and shape during the cooling process.

SUMMARY

In accordance with the disclosed subject matter, a base for a container is provided. The base includes an outer support wall, a support surface extending radially inward from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion, a third radiused portion extending radially inward from the intermediate surface and convex relative to the reference plane, and a central portion disposed proximate the third radiused portion.

As embodied herein, the intermediate surface can be substantially parallel to the reference plane. Additionally or alternatively, and in accordance with another aspect of the disclosed subject matter, the intermediate surface can include a linear portion extending radially inward from the second radiused portion, and an intermediate radiused portion extending radially inward from the linear portion and concave relative to the reference plane.

Additionally, and as embodied herein, the central portion can include an inner core. The inner core can include a sidewall and a top surface extending from the sidewall. The top wall having a convex portion relative the reference plane. The base can further include a transition portion between the third radiused portion and the inner core.

Furthermore, and as embodied herein, the base can include a plurality of ribs extending from the central portion to the support surface and spaced apart to define a plurality of segments between the central portion and the support surface. The support surface can have a width of between about 4% to about 10% the width of the maximum cross-dimension of the base. At least an upper section of the inner support wall can extend inwardly at an angle of between about 15 degrees to about 85 degrees relative the reference plane.

Further in accordance with the disclosed subject matter, the base additionally can include a fourth radiused portion disposed between the support surface and the inner support wall, and/or a fifth radiused portion disposed between the support surface and the outer support wall. Further in accordance with the disclosed subject matter, a container is provided having a sidewall and a base as disclosed above and in further detail below, wherein the base defines a diaphragm extending generally to the side wall. Further in accordance with the disclosed subject matter, a method of blow-molding such a container is provided.

BRIEF DESCRIPTION OF THE DRAWINGS

FIG. 11A is a bottom perspective view of the embodiment of FIGS. 7-9. FIG. 11B is a bottom perspective view of the embodiment of FIGS. 4-6. FIG. 11C is a bottom perspective view of the embodiment of FIGS. 1-3.

FIG. 23A is a bottom perspective view of the embodiment of FIG. 21. FIG. 23B is a bottom perspective view of the embodiment of FIG. 20. FIG. 23C is a bottom perspective view of the embodiment of FIG. 18.

DETAILED DESCRIPTION

Figure 1:
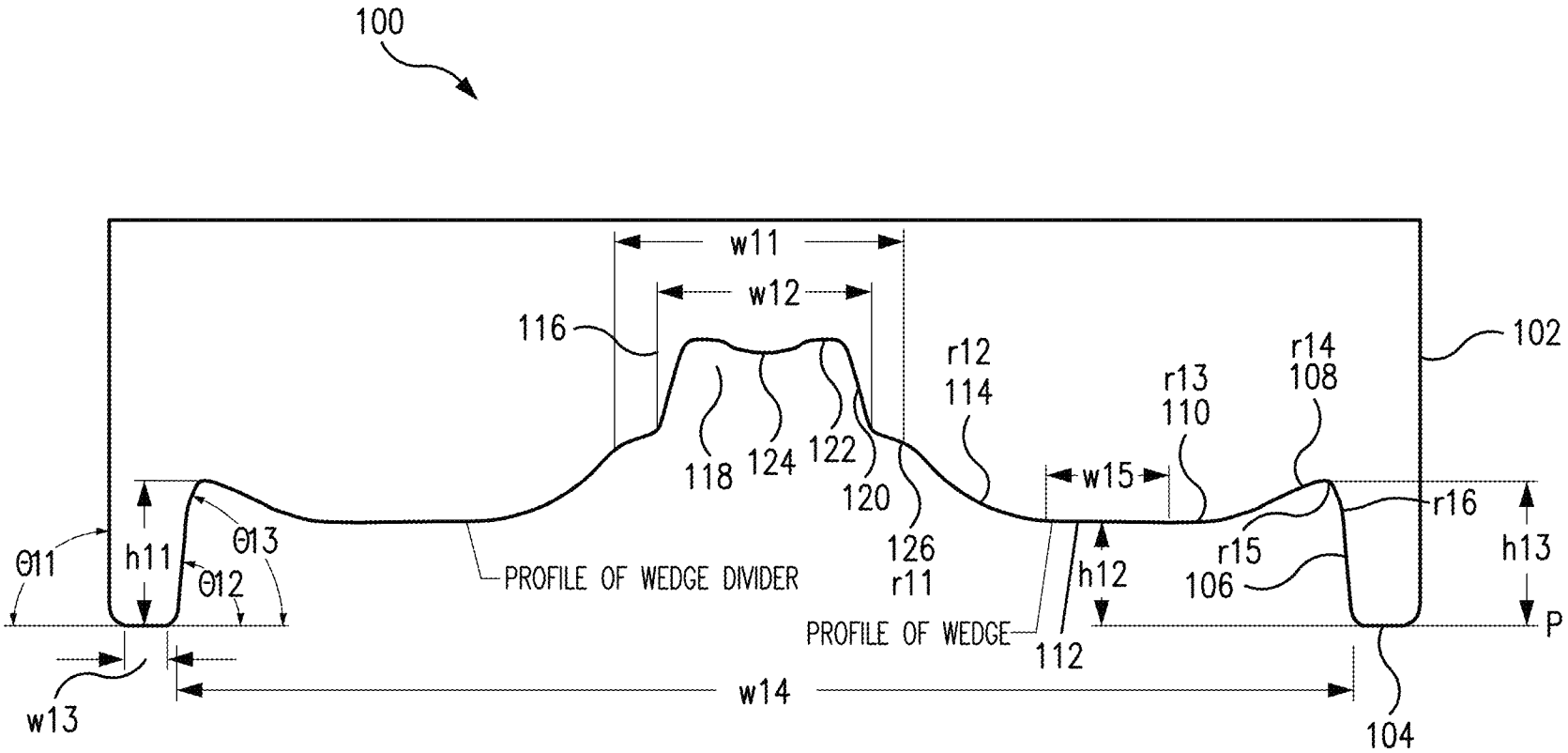
FIG. 1 is a front, cross-sectional schematic view of an exemplary embodiment of the base.

The apparatus and methods presented herein may be used for containers, including plastic containers, such as plastic containers for liquids. The containers and bases described herein can be formed from materials including, but not limited to, polyethylene terephthalate (PET), polyethylene naphthalate (PEN) and PEN-blends, polypropylene (PP), high-density polyethylene (HDPE), and can also include monolayer blended scavengers or other catalytic scavengers as well as multi-layer structures including discrete layers of a barrier material, such as nylon or ethylene vinyl alcohol (EVOH) or other oxygen scavengers. The disclosed subject matter is particularly suited for hot-fillable containers having a base design that is reactive to internal and external pressure due to pressure filling and/or due to thermal expansion from hot filling to provide controlled deformation that preserves the structure, shape and functionality of the container. The container base can also provide substantially uniform controlled deformation when vacuum pressure is applied, for example due to product contraction from product cooling.

In accordance with the disclosed subject matter herein, the disclosed subject matter includes a base for a container having a sidewall. The base includes a support surface defining a reference plane, an inner wall extending upwardly from the support surface, a first radiused portion extending radially inward from the inner wall and concave relative to the reference plane, a second radiused portion extending radially inward from the first radiused portion and convex relative to the reference plane, an intermediate surface extending radially inward from the second radiused portion, a third radiused portion extending radially inward from the inner surface and convex relative to the reference plane, and an inner core disposed proximate the third radiused portion to define a central portion of the base. As discussed further below, at least a portion of the intermediate surface can be linear in cross section. The base can also include an outer support wall, which can be an extension of the container side. In additional embodiments in accordance with the disclosed subject matter, the base further includes a fourth radiused portion disposed between the support surface and the inner support wall, and/or a fifth radiused portion disposed between the support surface and the outer support wall. As described further below, each radiused portion defines a hinge for relative movement therebetween, such that at least a portion of the base acts as a diaphragm.

Reference will now be made in detail to the various exemplary embodiments of the disclosed subject matter, exemplary embodiments of which are illustrated in the accompanying drawings. The structure of the base for the container of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the base and container with the disclosed subject matter are shown in the accompanying figures. The base is suitable for the manufacture of containers such as, bottles, jars and the like. Such containers incorporating the base can be used with a wide variety of perishable and nonperishable goods. However, for purpose of understanding, reference will be made to the use of the base for a container disclosed herein with liquid or semi-liquid products such as sodas, juices, sports drinks, energy drinks, teas, coffees, sauces, dips, jams and the like, wherein the container can be pressure filled with a hot liquid or non-contact (i.e., direct drop) filler, such as a non-pressurized filler, and further used for transporting, serving, storing, and/or re-using such products while maintaining a desired shape, including providing a support surface for standing the container on a table or other substantially flat surface. Containers having a base described herein can be further utilized for sterilization, such as retort sterilization, and pasteurization of products contained therein. As described in further detail below, the container can have a base configuration to provide improved sensitivity and controlled deformation from applied forces, for example resulting from pressurized filling, sterilization or pasteurization and resulting thermal expansion due to hot liquid contents and/or vacuum deformation due to cooling of a liquid product filled therein. The base configuration can influence controlled deformation from positive container pressure, for example resulting from expansion of liquid at increased temperatures or elevations. For purpose of illustration, and not limitation, reference will be made herein to a base and a container incorporating a base that is intended to be hot-filled with a liquid product, such as tea, sports drink, energy drink or other similar liquid product.

Figure 2A:
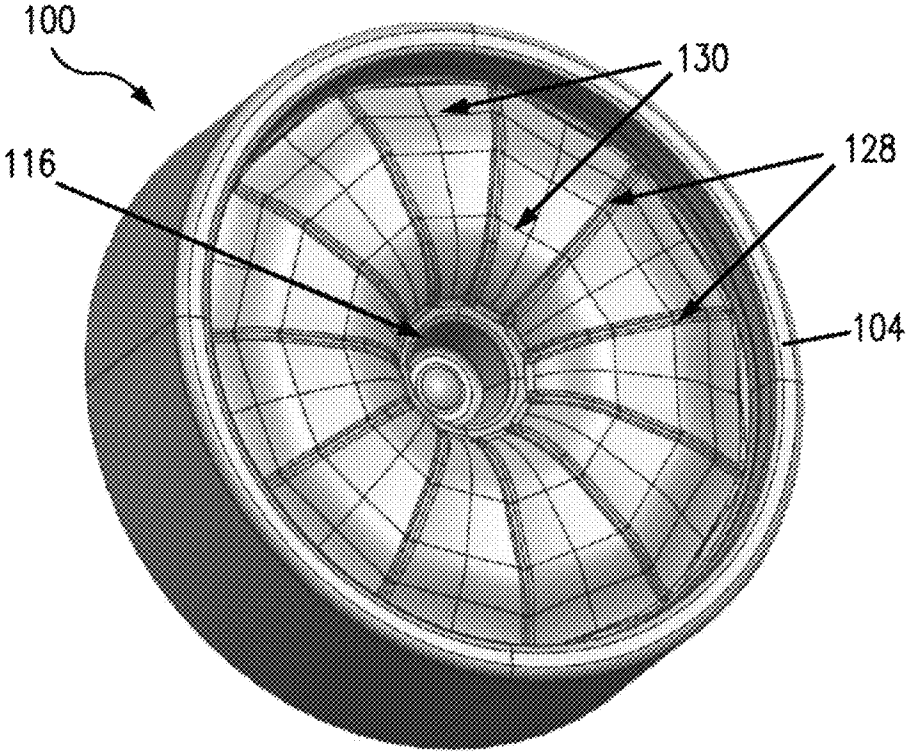
FIG. 2A is a bottom left perspective view of the exemplary embodiment of FIG. 1.
Figure 2B:
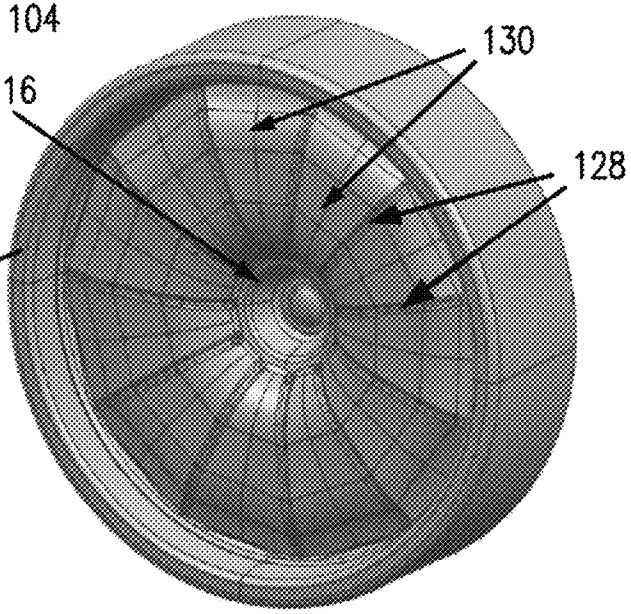
FIG. 2B is a bottom right perspective view of the exemplary embodiment of FIG. 1.
Figure 2C:
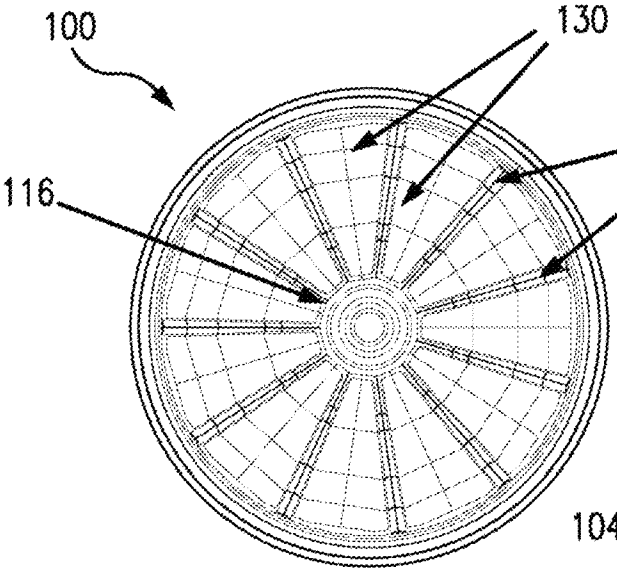
FIG. 2C is a bottom plan view of the exemplary embodiment of FIG. 1.
Figure 3:
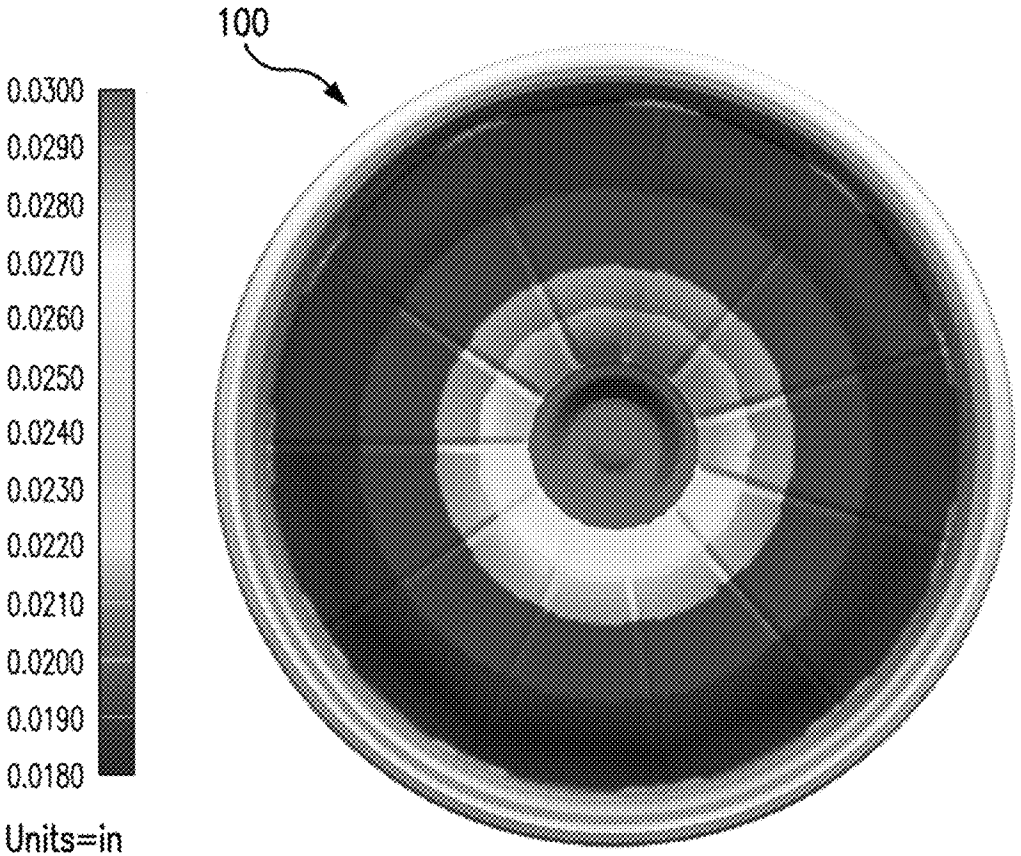
FIG. 3 is a bottom view of the exemplary embodiment of FIG. 1, illustrating the thickness of the base at various points.

FIGS. 1-3 illustrate exemplary embodiments of the disclosed subject matter. With reference to FIG. 1, the base 100 generally defines a diaphragm including a series of radiused portions. The multiple radiused portions can allow the base 100 to deform in a desired manner from circumferential stress concentrations. As shown in FIG. 2A-3, the base 100 generally can include any number of radial segments between the radiused portions to proportionally distribute the force differential between the inside and outside of the container to provide a low spring rate, that is change in resistance due to pressure change.

As shown for example in FIGS. 1-3, the base 100 can include an outer support wall 102, a support surface 104 extending inwardly from the outer support wall 102 and defining a reference plane P, and an inner support wall 106 extending upwardly from the support surface 104. In accordance with the disclosed subject matter, a first radiused portion 108 extends radially inward from the inner support wall 106 and concave relative to the reference plane P. A second radiused portion 110 extends radially inward from the first radiused portion 108 and convex relative to the reference plane P. An intermediate surface 112 extends radially inward from the second radiused portion 110 and substantially parallel to the reference plane P. A third internal radiused portion 114 extends radially inward from the intermediate surface 112 and convex to the reference plane P to a central portion 116. The intermediate surface 112 can include at least a portion that is substantially flat or linear in shape, and can extend at an angle substantially parallel (i.e., +/−10 degrees) relative to the reference plane P.

The central portion 116 can be configured to form a variety of suitable shapes and profiles. For example, and as depicted, the central portion 116 can be provided with an inner core 118. The inner core 118 can have a generally frustoconical shape or the like and can be shallow or deep as desired. By way of example, the inner core 118 can comprise a sidewall 120 and a top surface 122 extending from the sidewall 120, the top surface 122 having a convex portion 124 relative to the reference plane P.

As further defined herein, the radiused portions generally function as hinges to control at least in part the dynamic movement of the base 100. For example, the first radiused portion 108 can be configured as a primary contributor to both the ease with which the base 100 deforms and the amount of deformation. With reference to the exemplary embodiments disclosed in FIG. 1, the second and third radiused portions 110, 114 can cooperate with the first radiused portion 108 and provide for additional deformation, such as approximately 10-20% or more of total base displacement.

Each radiused portion can be configured to deform in conjunction with the other. For example, a change to the geometry and/or relative location of either of the third radiused portion 114 or second radiused portion 110 can affect the deformation response of the first radiused portion 108. As described further below, a transition portion 126 between the third radiused portion 114 and the central portion 116 can also be configured to affect the efficiency or response of the base deformation. Furthermore, the length of the intermediate surface 112 can be selected to affect such deformation based upon its relationship with the second and third radiused portions 110, 114. In this manner a diaphragm can be designed and tailored based upon the interactions of these base portions to provide a desired performance and effect.

In addition to the profile of the base 100 as defined by the radiused portion locations, the radius of the transition portion 126 between the inner core 118 and the third radiused portion 114, as well as the conical shape of the inner core 118, can be modified to increase or decrease the spring rate or response to pressure differentials, which can accommodate a range of thermodynamic environments, such as variations in hot-fill filling lines. The base profile can also allow the base 100 to be scaled to containers of different overall shapes such as oval, square or rectangular shapes and different sizes while maintaining consistent thermal and pressure performance characteristics.

The overall design and contour of the base profile, or a portion thereof, can act as a diaphragm responsive to negative internal pressure or vacuum as well as positive internal pressure. The diaphragm can aid in concentrating and distributing axial stress. With reference to the exemplary embodiment of FIG. 1-3, the effective area of the diaphragm can be measured as the portion of the base extending diametrically from the top of the inner support wall 106 on one side of the container to the top of the inner support wall 106 on the opposite side. The differential in pressure between the inside of the container and outside of the container can flex the base 100 in a controlled manner. The concentration of stress can be rapidly distributed to radiate outwardly from the center of the base 100 in a uniform circumferential manner. The stress concentrations in the base thus can be directed circumferentially at or around the radiused portions in the diaphragm plane and extend out in a wave manner.

FIGS. 2A-2B show a bottom left perspective and bottom right perspective view, respectively, of the exemplary embodiment of FIG. 1. FIG. 2C shows a bottom plan view of the exemplary embodiment of FIG. 1. FIG. 3 shows a bottom view of the exemplary embodiment of FIG. 1, illustrating the thickness of the base 100 at various points. With reference to FIGS. 2A-3, the base design can further include ribs 128 to form base segments 130 that can cooperate with the radial radiused portions to improve strength and resistance to deformation or roll out from positive pressure. The geometry of the ribs 128 that divide the segments 130 can provide support to the base 100 as it radiates out to the support surface 104. The base 100 can deform more efficiently without the segments 130 when only internal vacuum is considered. However through testing it was determined that the use of the segments 130 can further prevent the base 100 from deforming in an uncontrolled manner and/or to an unrecoverable state, and thus provides a structural support response to internal positive pressure caused by thermal expansion during the filling and capping process which ultimately results in predicted/controlled and improved response to vacuum. Thus, while typical prior art container base vacuum panel technology focuses on the performance of the panel in response to a vacuum (i.e., negative pressure), embodiments disclosed herein can further address performance of the panel in response to the positive pressure exerted during filling and capping.

Figure 26:
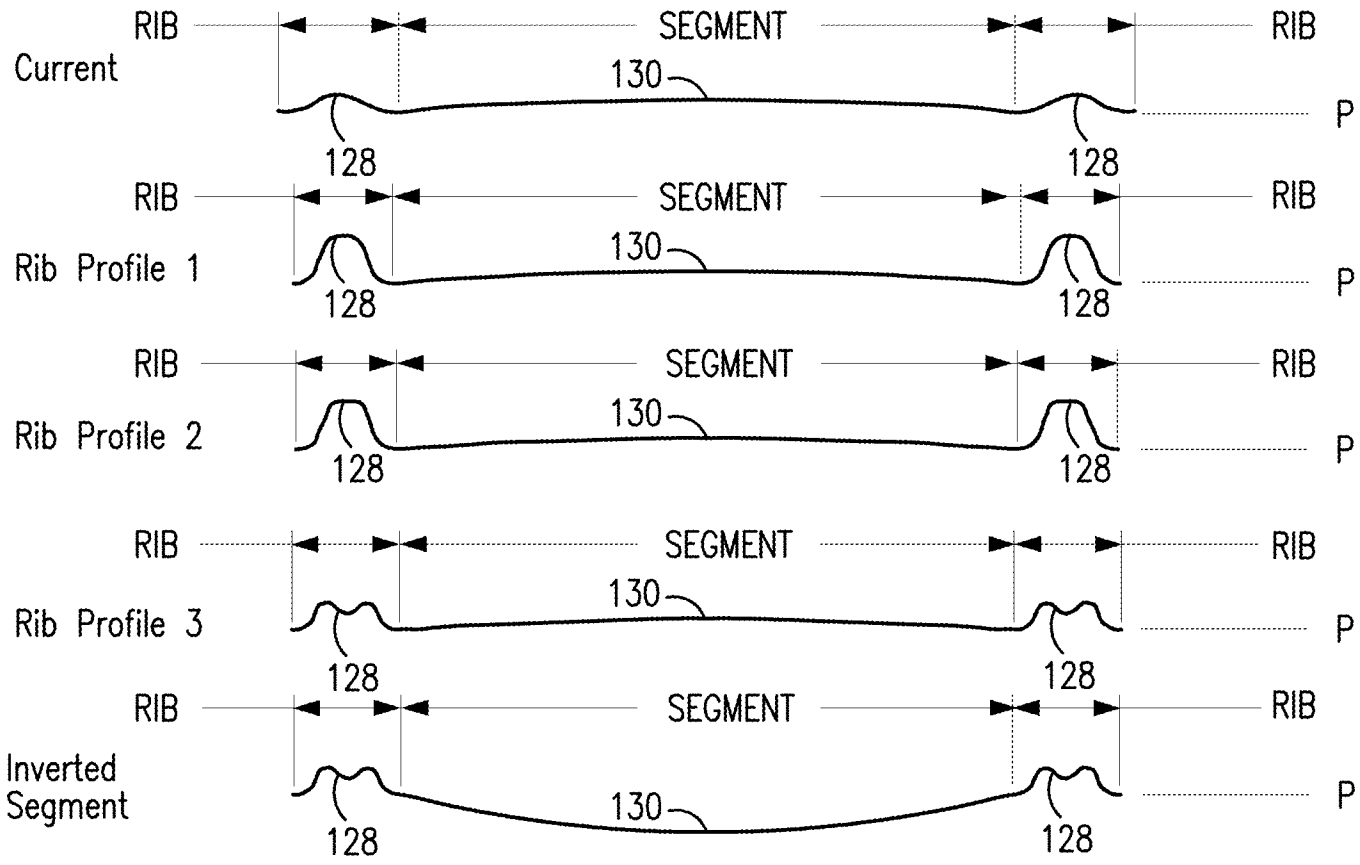
FIG. 26 is a front, cross-sectional schematic view of exemplary bases illustrating exemplary rib profiles, for purpose of comparison, in accordance with the disclosed subject matter.

Further in accordance with the disclosed subject matter, the base, and thus the container, can be configured with any of a variety of different shapes, such as a faceted shape, a square shape, oval shape (see FIG. 4) or any other suitable shape. In this manner, each segment 130, if provided, can be formed as a wedge and can serve as a discrete segment of the base. The segment can have a profile that matches the base profile of FIG. 1 when viewed in that direction. When viewing the cross section of the segment as it extends radially out from the center longitudinal axis, each segment can have a convex or concave shape relative to the reference plane P as in FIG. 26. A segment 130 that is convex-shaped when referring to the reference plane P can create small regions that can invert displacing volume in the presence of vacuum. As such, volume displacement can be reduced relative to the entire base or diaphragm structure movement. A segment 130 that is concave-shaped relative to the reference plane P can improve control of deformation from internal pressure. The concave shape can further control total base movement. The ribs 128 dividing the base 100 can further support or tie the base together circumferentially. The ribs 128 can be formed continuously along the base 100 from the inner core 118 to the support surface 104. Alternatively, the ribs 128 can be formed with discontinuities, for example having discontinuities along the base 100 at the points where any or all of the radiused portions are formed. In addition, the rib cross section as viewed in FIG. 26 can have varying shapes and sizes as defined in FIG. 26.

The base segments 130 can each function independently to provide variable movement of the base 100 and can result in displacement in response to small changes in internal or external changes in container pressure. The combined structure of the individual segments 130 and the ribs 128 dividing the segments 130 can reduce the reaction or displacement to positive pressure while increasing or maintaining sensitivity to negative internal pressure. The base segments 130 can move independently in response to the force or rate of pressure change. Thus, each base segment 130 or area within the segment can provide a secondary finite response to vacuum deformation and product displacement. As such, the combination of segments 130 and dividing ribs 128 can adapt or compensate to variations in wall thicknesses and gate locations among containers formed using base 100 that would otherwise cause inconsistent or incomplete base movement as found in the control. The movement of the segments can be secondary to primary movement or deflection of the overall base diaphragm structure, which can be affected by the base geometry and radiused portions, as described herein.

Current and earlier base technologies have also used mechanical actuation as a method to compensate for product contraction. These technologies have incorporated segments or scallops as part of the design of the base, and in these particular instances, the segments—and specifically the area in between the segments—were needed to provide uniform base movement as the base was mechanically inverted. To achieve this, the area between the segments flex or deform to maintain the shape of the segment and maximize the volume displaced by inversion as all the segments around the circumference of the base invert consistently. Without these breaks in the geometry, the base could invert in an uneven and uncontrolled manner. In the case of the present variable displacement base, the segments 130, either concave or convex in shape when viewing the cross section from the central longitudinal axis out to the major diameter, can react individually as a response to either internal positive or negative pressure. The deformation that occurs reacts in the actual segment surface as opposed to the area in between the segment. It is through this action that the segments 130 can respond individually such that base 100 can respond dynamically to multiple forces and maintain consistent total base deformation.

In this manner, base 100 can respond or deform in a controlled manner from the positive internal pressure. The controlled deformation can prevent the base diaphragm region from extending down past the standing ring, which may define reference plane P or support surface 104, while providing a geometry that can respond dynamically to internal vacuum pressure. Base 100 can exhibit a small degree of relaxation or thermal creep due to hot fill temperatures and the resulting positive pressure from thermal expansion within the container. The environmental effect of temperature, pressure and time can interact with base 100 to provide a controlled deformation shape. Due at least in part to the response of the material to heat and pressure, some elastic hysteresis can prevent base 100 from returning to its original molded shape when all forces are removed. It was discovered through analysis and physical testing that the design of the base profile, segments 130 and ribs 128 would lead to an initial surface geometry that, when subjected to the positive pressure of hot filling and capping, results in a shape that also responds efficiently to internal vacuum pressures. Thus, after hot filling and capping, the resulting shape of base 100 can be considered a preloaded condition from which the bottle base can be designed to respond to vacuum deformation from the negative internal pressure created by product contraction during cooling.

Figure 4:
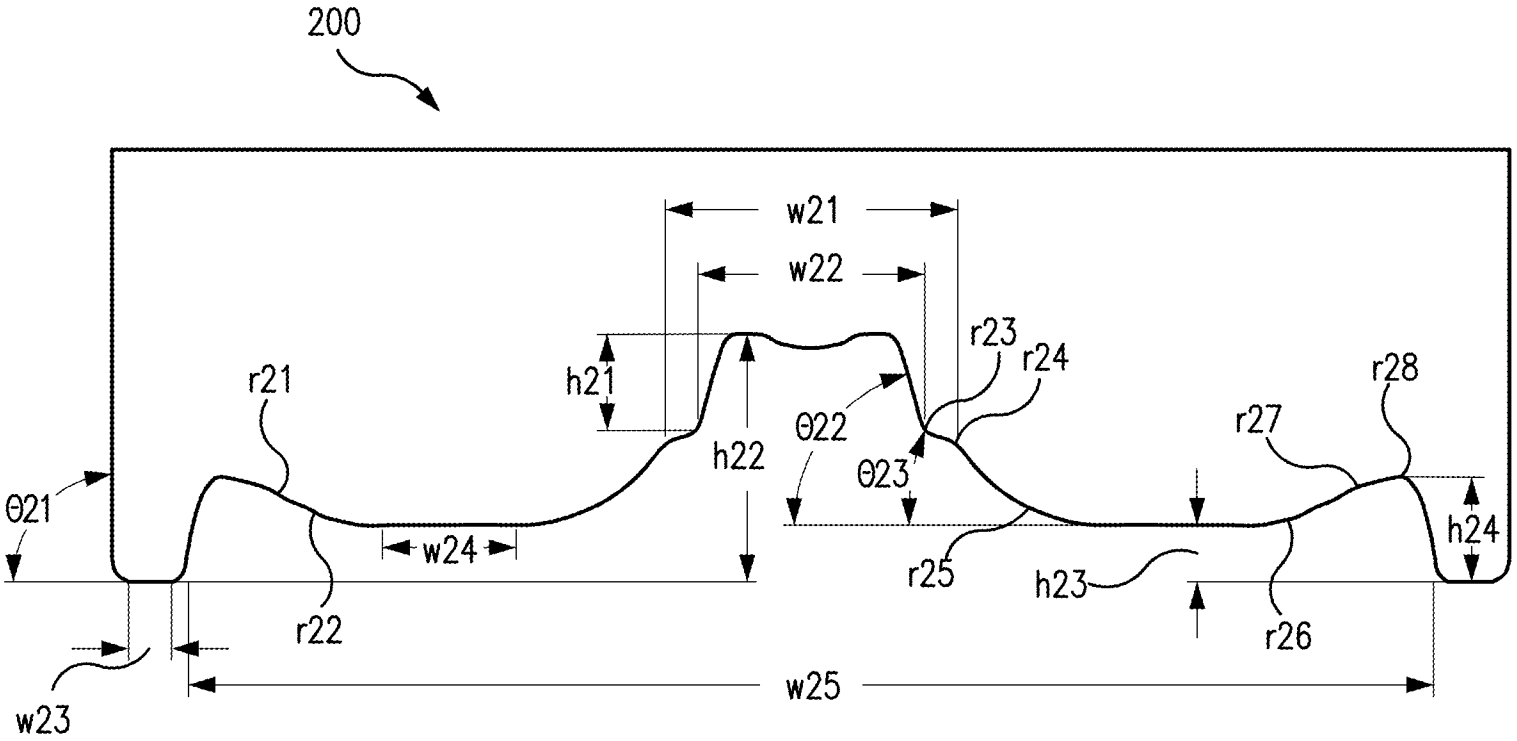
FIG. 4 is a front, cross-sectional schematic view of another exemplary embodiment of a base in accordance with the disclosed subject matter.
Figure 5:
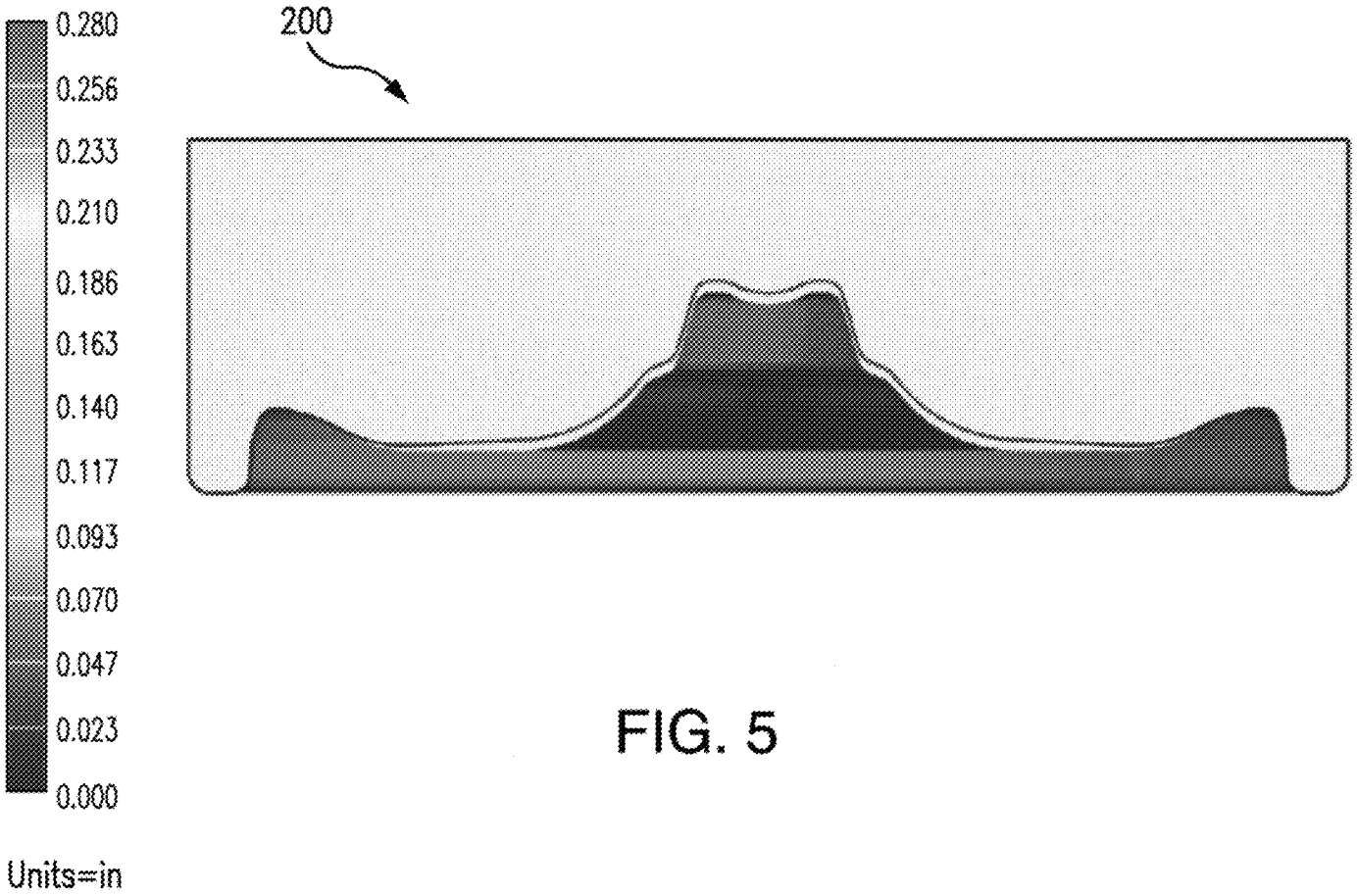
FIG. 5 is a front, cross-sectional schematic view illustrating additional features of the exemplary embodiment of FIG. 4.
Figure 6:
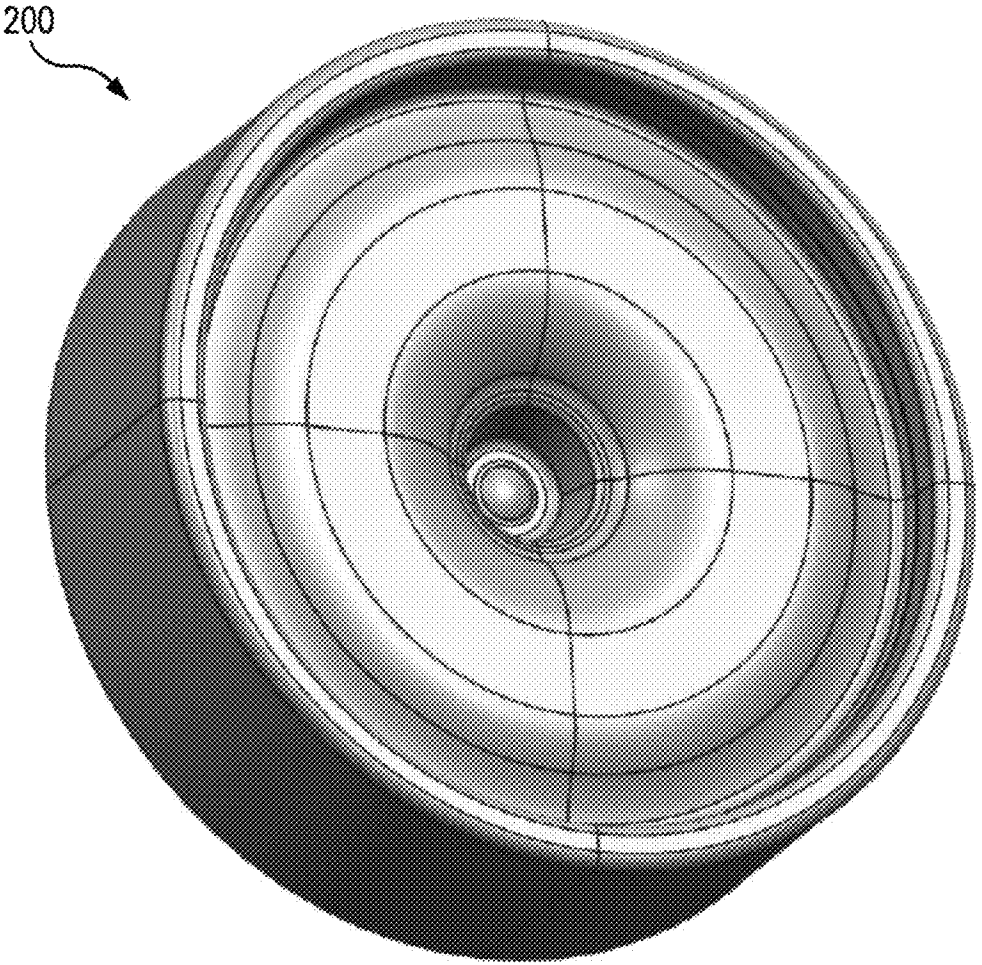
FIG. 6 is a bottom perspective view of the exemplary embodiment of FIG. 4.

Using the base profile as disclosed, a variety of embodiments can be configured as depicted in the figures, for purpose of illustration and not limitation. For example, FIGS. 4-6 illustrate an exemplary embodiment of a base 200 in accordance with the disclosed subject matter, shown without ribs, and having different dimensions. FIGS. 4 and 5 each shows a front, cross-sectional schematic view of the exemplary embodiment of base 200. FIG. 6 shows a bottom perspective view of the exemplary embodiment of base 200.

Figure 7:
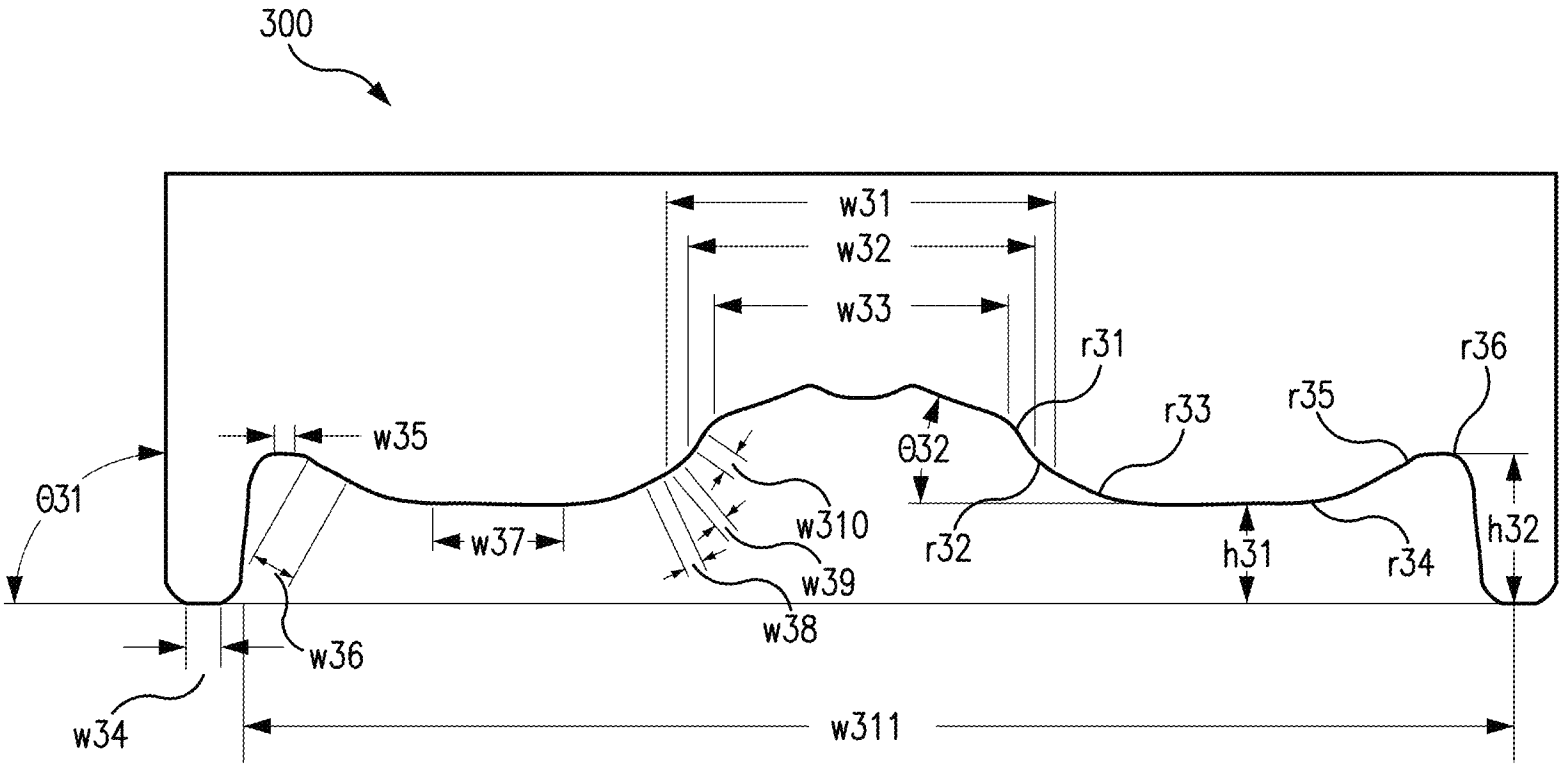
FIG. 7 is a front, cross-sectional schematic view of another exemplary embodiment of a base in accordance with the disclosed subject matter.
Figure 8:
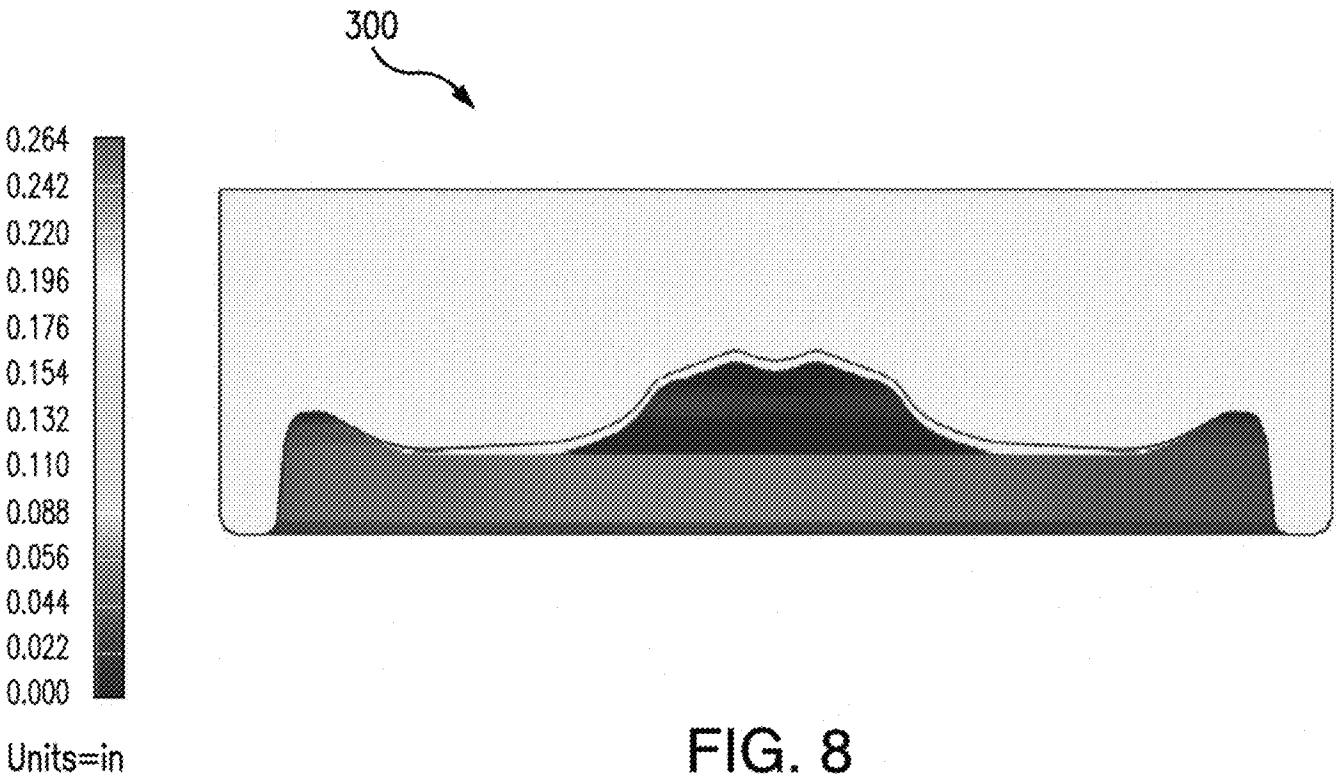
FIG. 8 is a front, cross-sectional schematic view illustrating additional features of the exemplary embodiment of FIG. 7.
Figure 9:
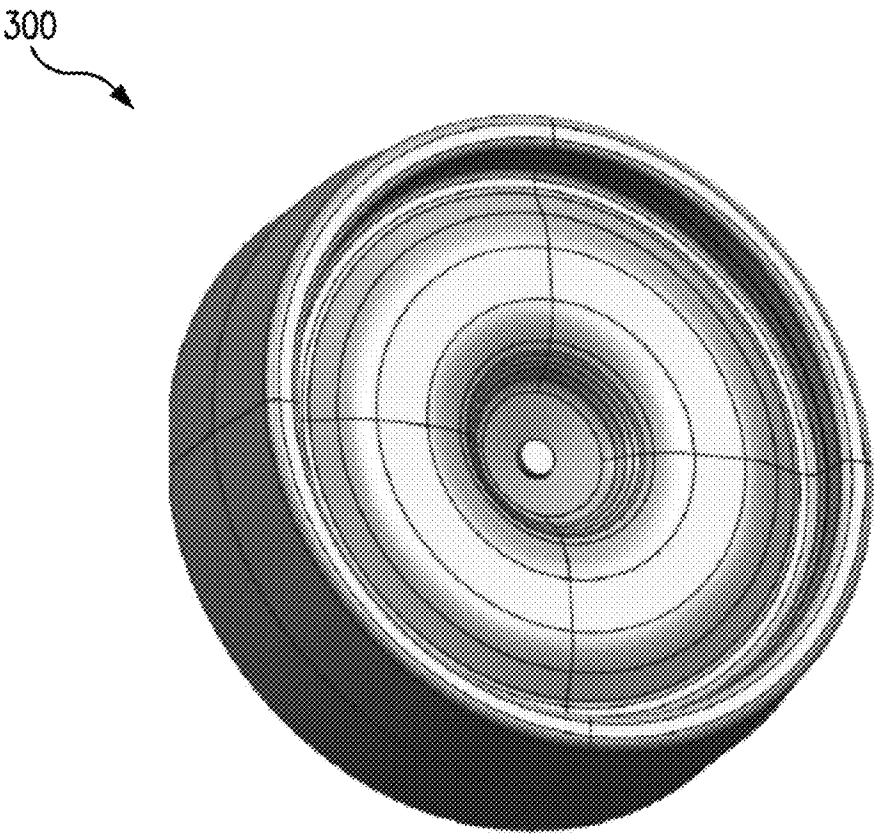
FIG. 9 is a bottom perspective view of the exemplary embodiment of FIG. 7.

FIGS. 7-9 illustrate another exemplary embodiment of a base 300 in accordance with the disclosed subject matter having different dimensions. FIGS. 7 and 8 each shows a front, cross-sectional schematic view of the exemplary embodiment of the base 300. FIG. 9 shows a bottom perspective view of the exemplary embodiment of base 300.

Figure 10:
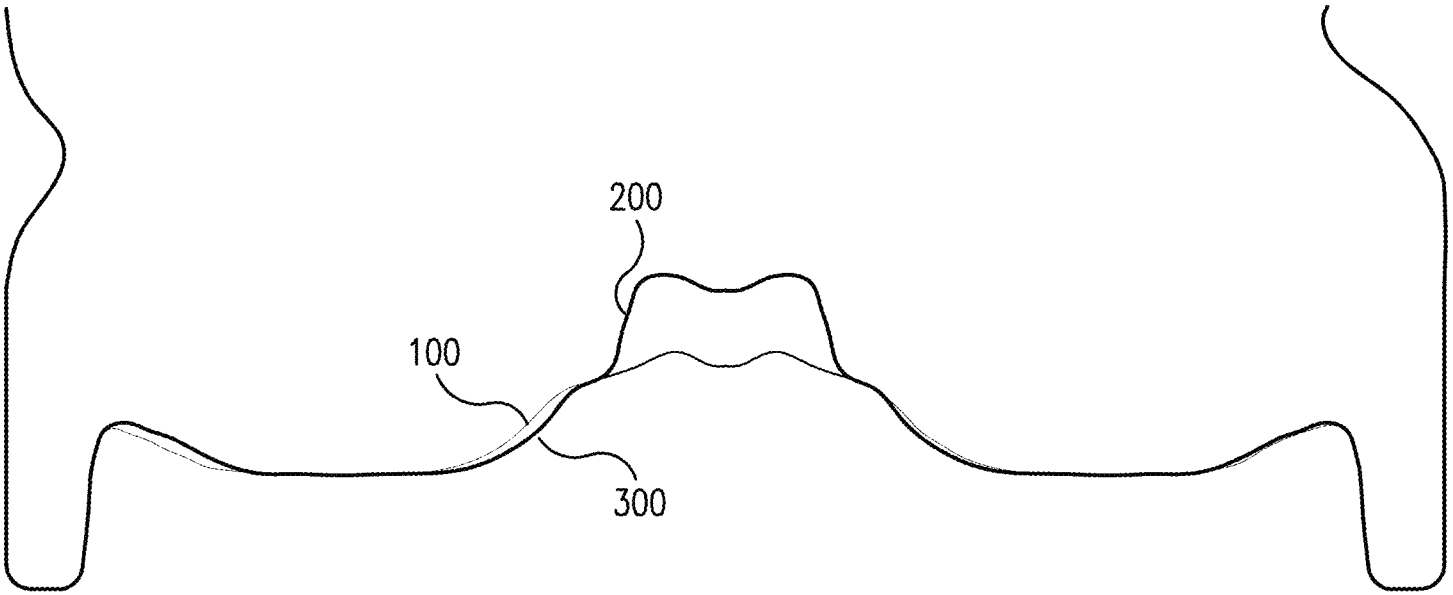
FIG. 10 is a front, cross-sectional schematic view of each of the exemplary embodiments of FIGS. 1-9 overlaid on each other, for purpose of comparison.
Figure 11A:
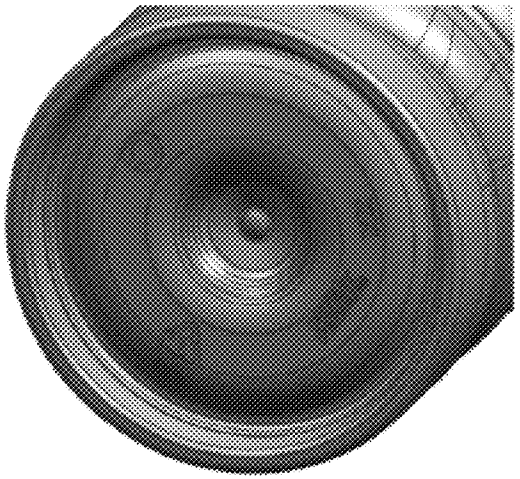
FIGS. 11A-11C each is a bottom perspective view of one of the exemplary embodiments of FIGS. 1-9, shown side-by-side for purpose of comparison.
Figure 11B:
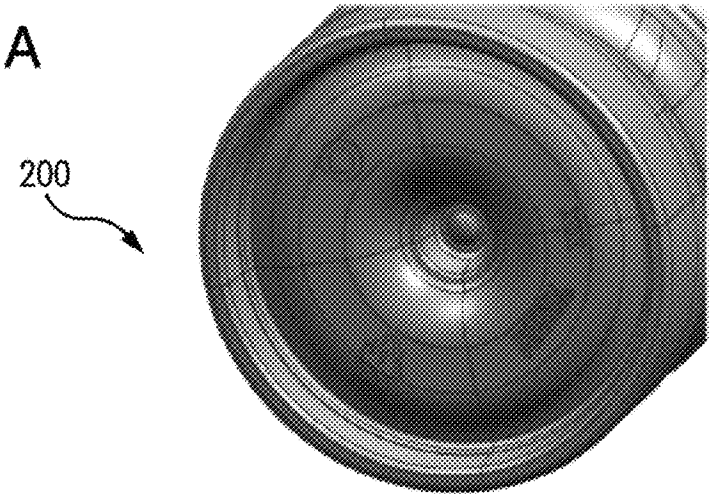
Figure 11C:
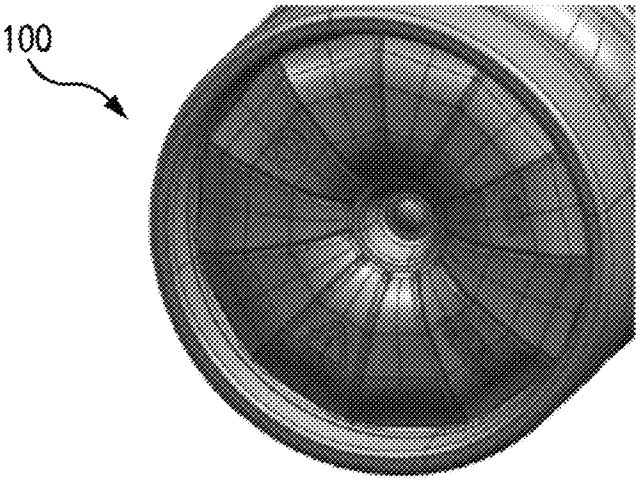

FIG. 10 shows front, cross-sectional schematic views of the exemplary embodiments of FIGS. 1-9 overlaid on each other, for purpose of comparison. FIGS. 11A-11C show bottom perspective views of the exemplary embodiments of FIGS. 1-9 side-by-side for purpose of comparison. FIG. 11A shows a bottom perspective view of the embodiment of FIGS. 7-9. FIG. 11B shows a bottom perspective view of the embodiment of FIGS. 4-6. FIG. 11C shows a bottom perspective view of the embodiment of FIGS. 1-3.

Figure 12:
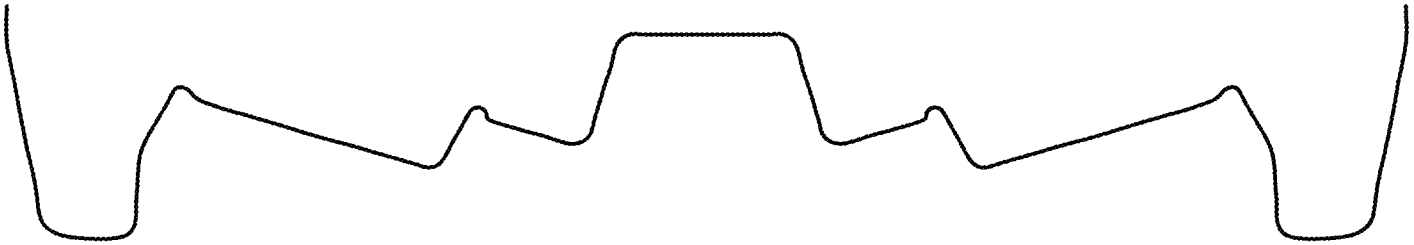
FIG. 12 Prior Art
FIG. 12 is a cross-sectional schematic view of a known, current base for a container, for purpose of comparison to the exemplary embodiments of the disclosed subject matter.
Figure 13:
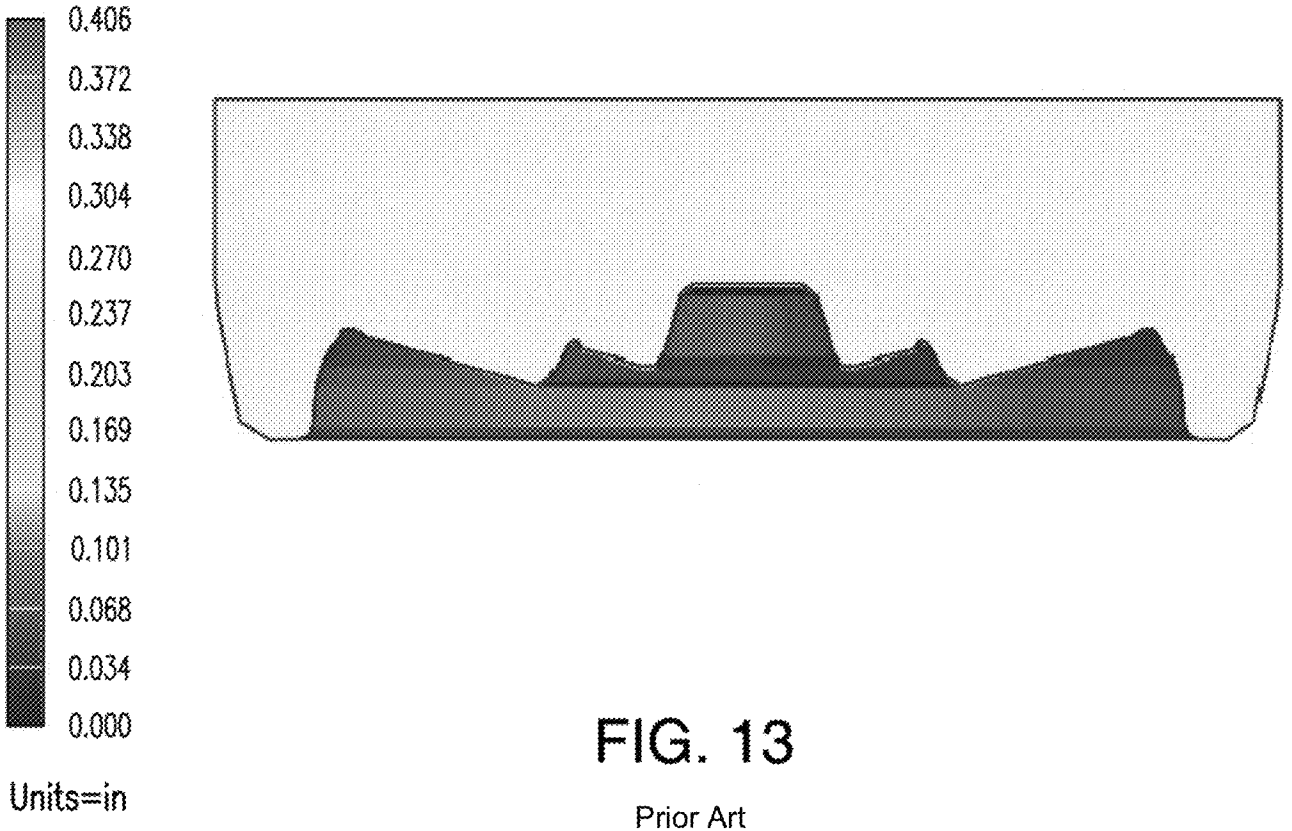
FIG. 13 Prior Art
FIG. 13 is a cross-sectional schematic view of another known, current base for a container, for purpose of comparison to the exemplary embodiments of the disclosed subject matter.
Figure 14:
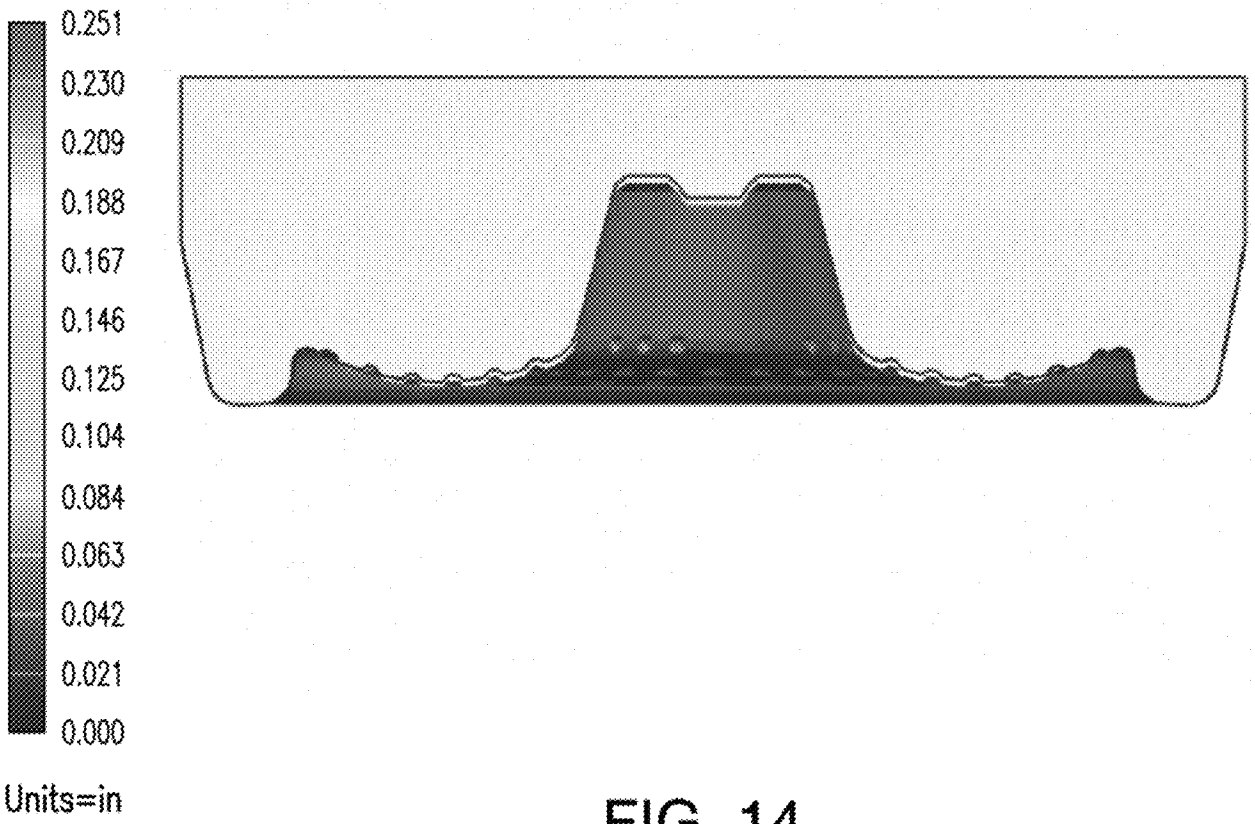
FIG. 14 Prior Art
FIG. 14 is a front, cross-sectional schematic view of another known, competitive base for a container, for purpose of comparison to the exemplary embodiments of the disclosed subject matter.

FIGS. 12 and 13 show cross-sectional schematic views of a known, current base for a container, for purpose of comparison to the exemplary embodiments of the disclosed subject matter. FIG. 14 shows a front, cross-sectional schematic view of a known, competitive base for a container, for purpose of comparison to the exemplary embodiments of the disclosed subject matter.

Figure 15:
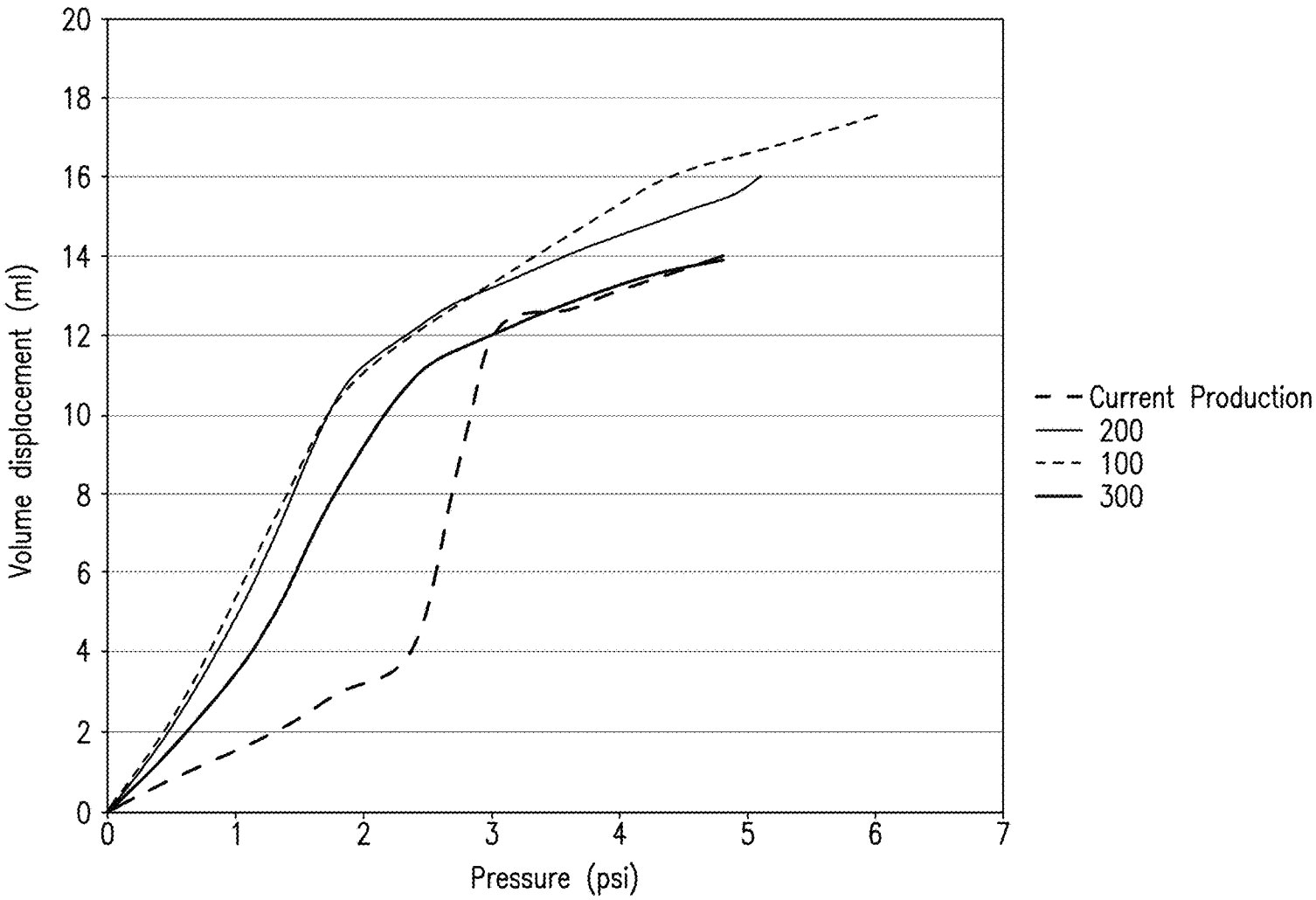
FIG. 15 is a graph illustrating the volume displacement response over a range of pressures for each of the embodiments of FIG. 1, FIG. 4 and FIG. 7 as compared to the known current base of FIG. 12.

For purpose of understanding and not limitation, a series of graphs are provided to demonstrate various operational characteristics achieved by the base and container disclosed herein. FIG. 15 shows a graph illustrating the volume displacement response over a range of pressures for the embodiments of FIG. 1 (ref 100), FIG. 4 (ref 200) and FIG. 7 (ref 300) as compared to the known current base of FIG. 12 (ref. Current Production). FIG. 15 illustrates a simulated volume displacement of each base increasing from an initial reference position over a range of applied vacuum pressure. As shown in FIG. 15, the embodiments of the disclosed subject matter exhibit a relatively uniform, linear displacement under applied vacuum pressure compared to the known current base.

Figure 16:
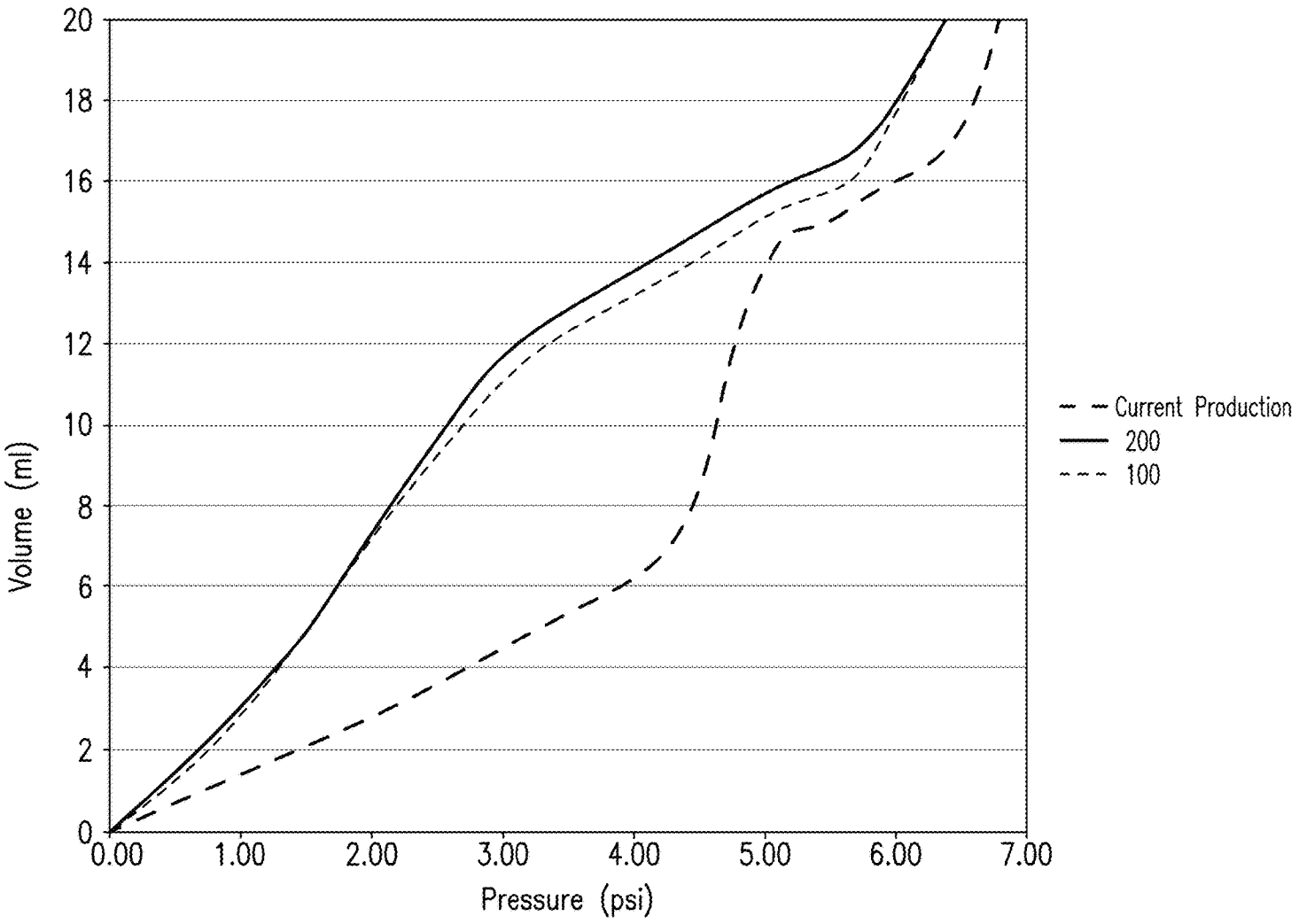
FIG. 16 is a graph illustrating the volume displacement response over a range of pressures for bottles having bases of each of the embodiments of FIG. 1 and FIG. 4 as compared to the known current base of FIG. 12.

FIG. 16 shows a graph illustrating the volume displacement response over a range of pressures for bottles having bases of the embodiments of FIG. 1 (ref 100) and FIG. 4 (ref 200) as compared to the known current base of FIG. 12 (ref. Current Production). FIG. 16 illustrates a simulated volume displacement of each base increasing from an initial reference position over a range of applied vacuum pressure. As shown in FIG. 16, the embodiments of the disclosed subject matter exhibit a relatively uniform, linear displacement under applied vacuum pressure compared to the known current base.

Figure 17:
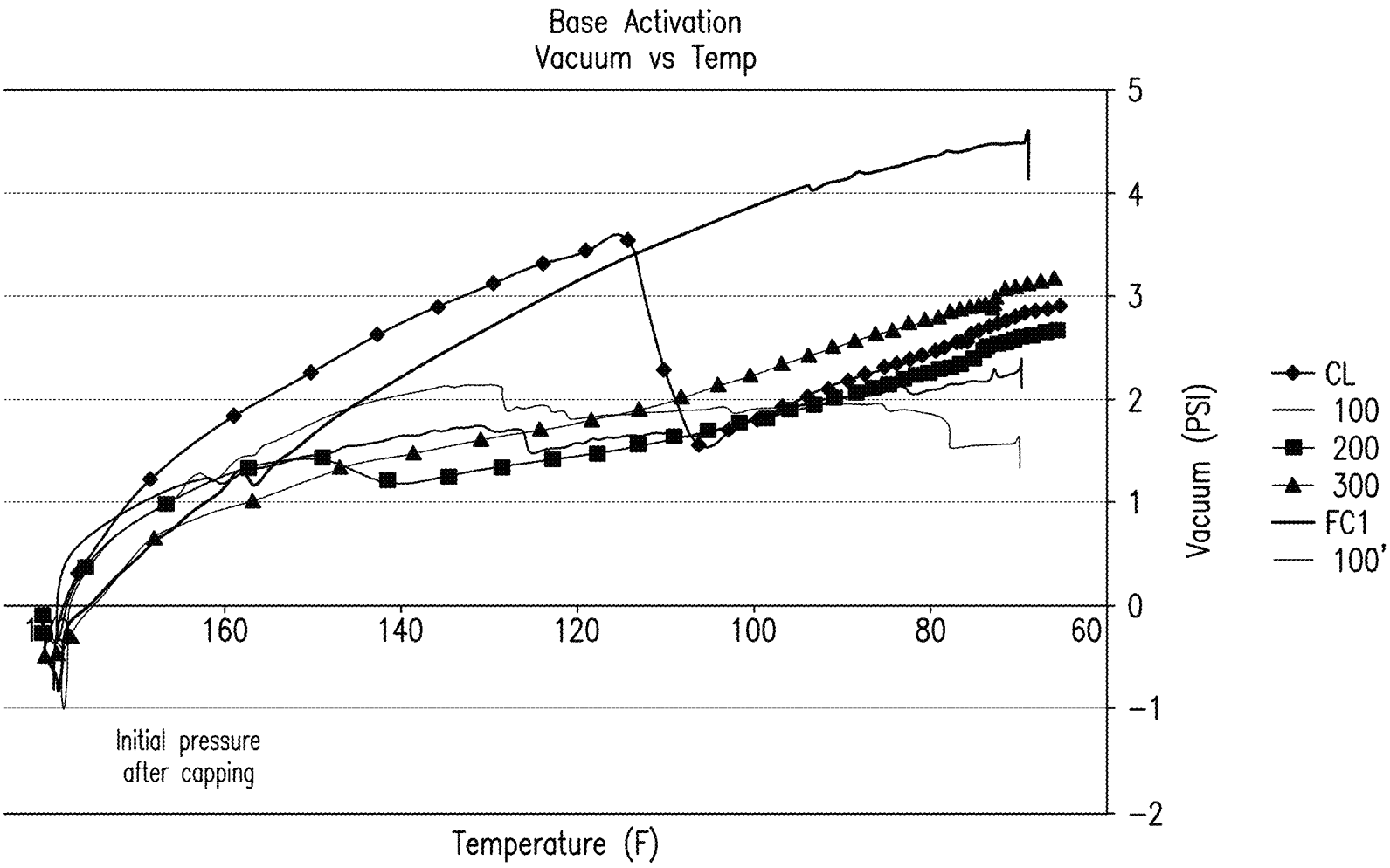
FIG. 17 is a graph of the internal vacuum over a range of decreasing temperatures in a container having bases of each of the embodiments of FIG. 1, FIG. 4, and FIG. 7 as compared to the known current base of FIG. 12.

FIG. 17 shows a graph of the internal vacuum over a range of decreasing temperatures in a container having bases of the embodiments of FIG. 1 (refs. 100, 100'), FIG. 4 (ref. 200), and FIG. 7 (ref 300) as compared to the known current base of FIG. 12 (refs. CL, FC1). FIG. 17 illustrates relative internal vacuum pressure data measured over a decreasing range of temperatures of the bottles after being filled with hot water and capped. As shown in FIG. 17, the embodiments of the disclosed subject matter exhibit a lower internal vacuum pressure due to the cooling of the liquid contents compared to the known current bases. As compared to the discontinuity shown in the current base CL at about 115-105 degrees F., which can be considered as a base activation point, the embodiments of the disclosed subject matter exhibit a more uniform, linear vacuum pressure in response to the liquid cooling. The base activation points of the exemplary embodiments, shown at about 125 degrees F. in 100 and 100' and 145 degrees F. in 200, occur at higher temperatures and result in less discontinuity in the vacuum pressure as compared to the known current base. FC1 exhibits a known current base on a production line that did not activate.

Figure 18:
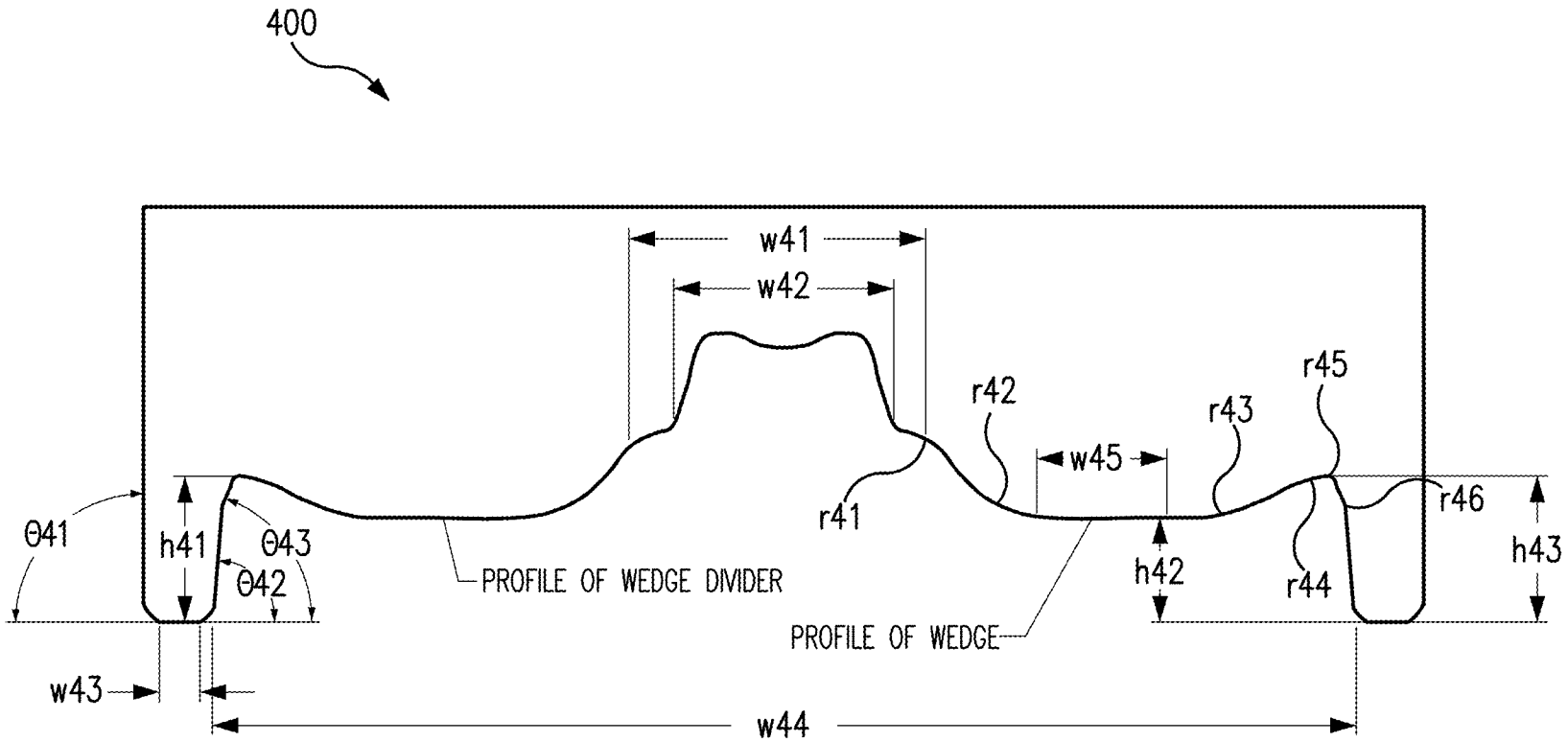
FIG. 18 is a front, cross-sectional schematic view of another exemplary embodiment a base in accordance with the disclosed subject matter.
Figure 19:
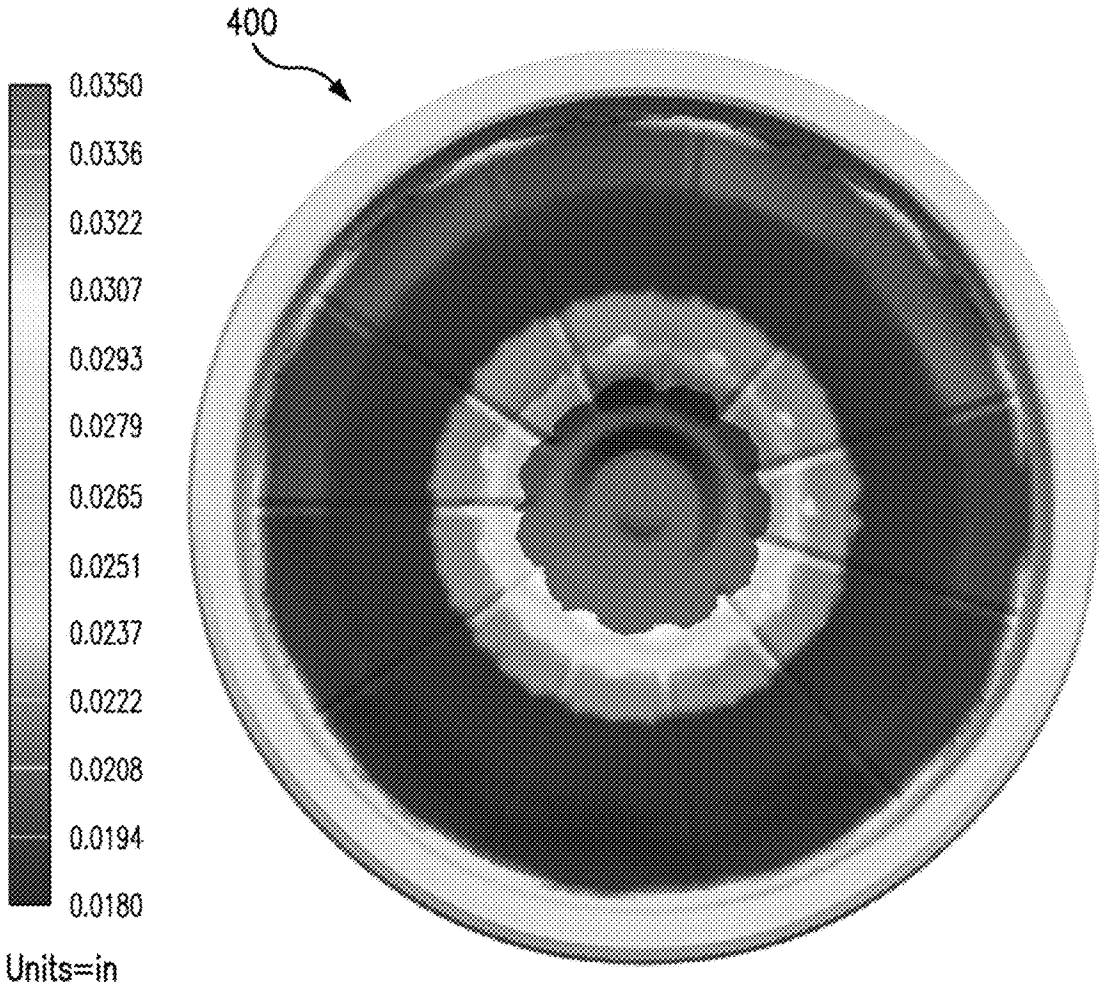
FIG. 19 is a bottom view of the exemplary embodiment of FIG. 18, illustrating the thickness of the base at various points.

FIGS. 18 and 19 illustrate yet another exemplary embodiment in accordance with the disclosed subject matter having different dimensions. FIG. 18 shows a front, cross-sectional schematic view of the exemplary embodiment of a base 400. FIG. 19 shows a bottom view of the exemplary embodiment of FIG. 18, illustrating the thickness of the base at various points.

Figure 20:
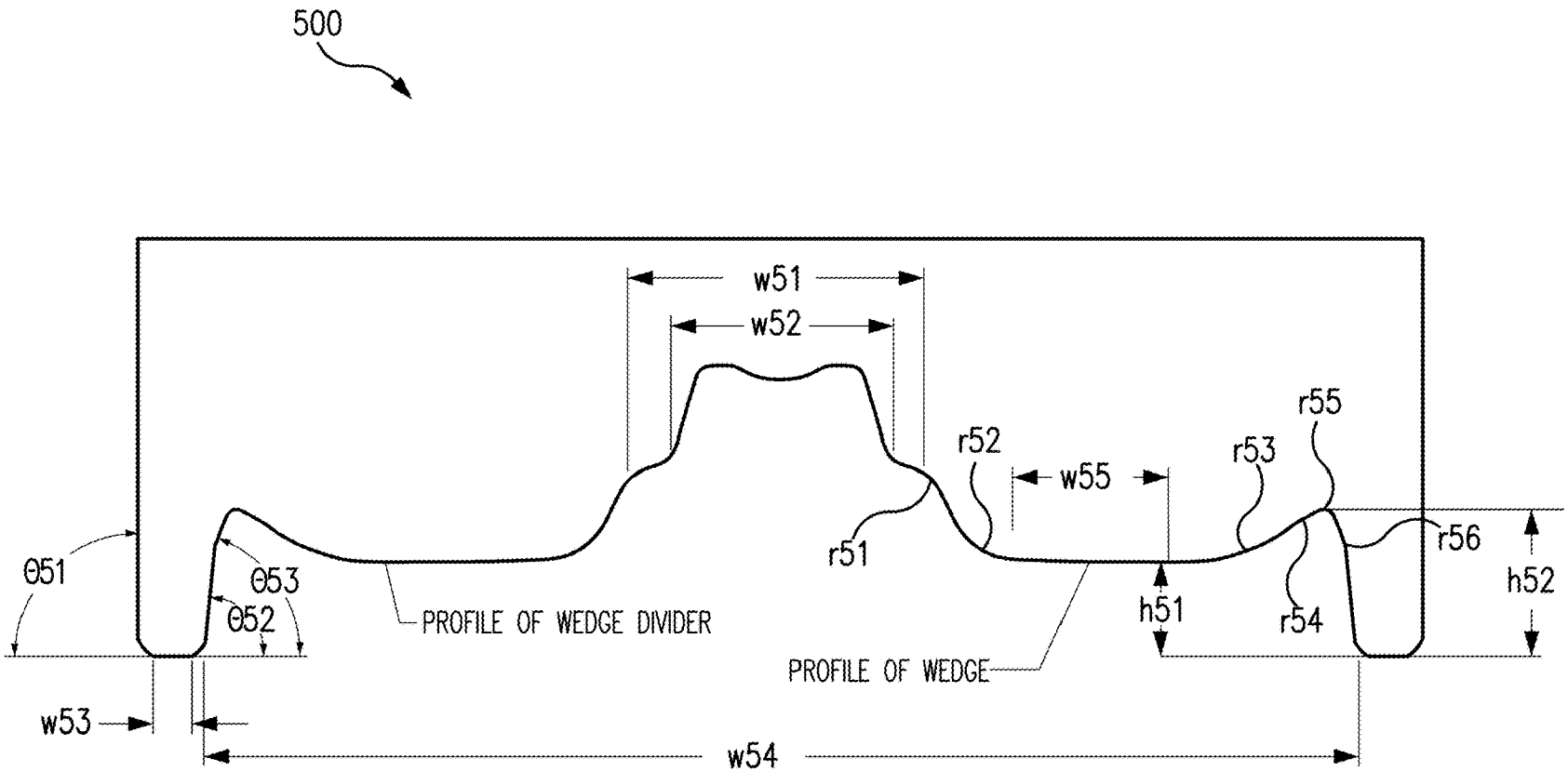
FIG. 20 is a front, cross-sectional schematic view of another exemplary embodiment of a base in accordance with the disclosed subject matter.
Figure 21:
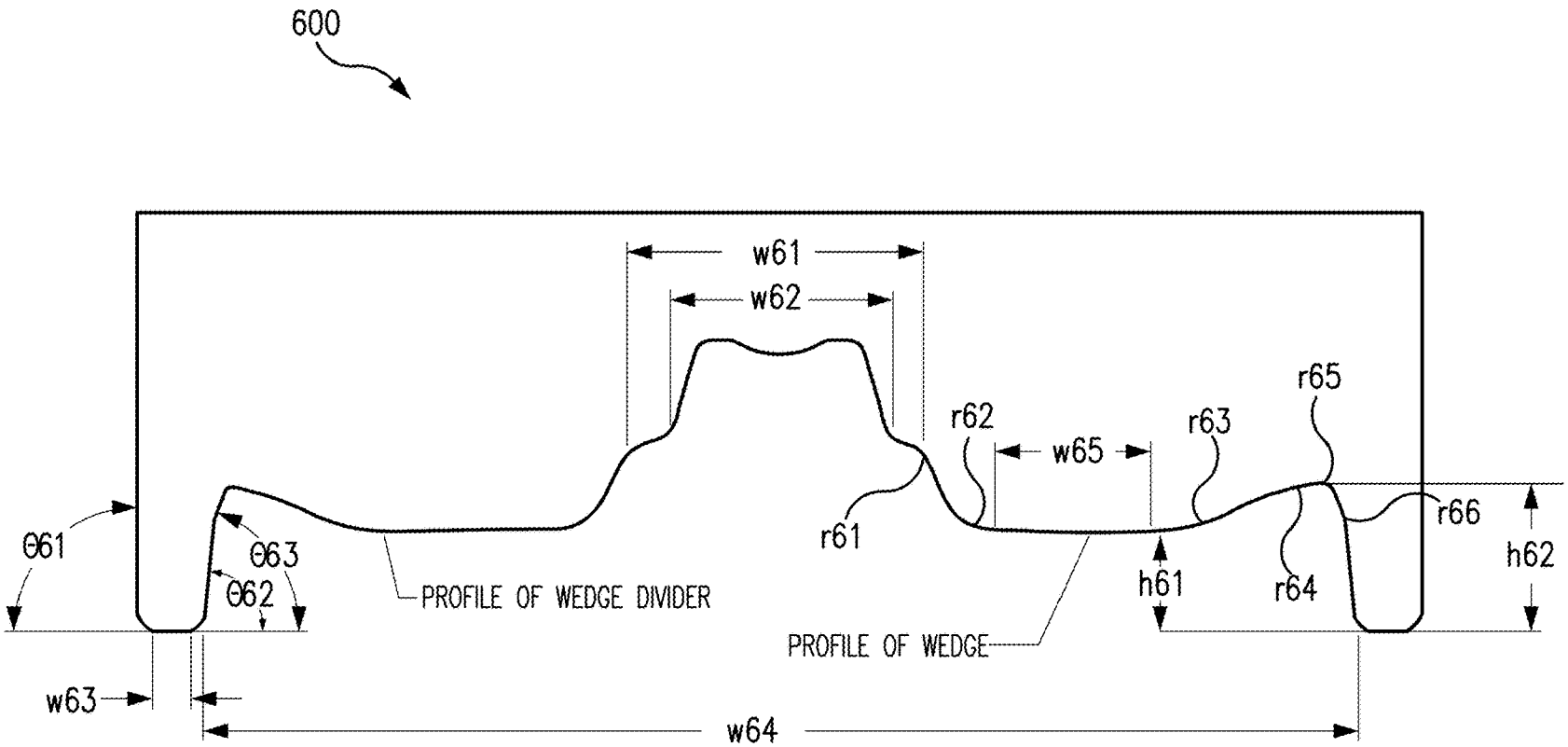
FIG. 21 is a front, cross-sectional schematic view of another exemplary embodiment of a base in accordance with the disclosed subject matter.

FIGS. 20 and 21 each shows a front, cross-sectional schematic view of yet another exemplary embodiment of a base 500, 600 in accordance with the disclosed subject matter having different dimensions.

For purpose of illustration and not limitation, exemplary dimensions and angles shown in FIGS. 1, 4, 7, 18, 20 and 21 are provided in Table 1. However, it will be apparent to those skilled in the art that various modifications and variations to the exemplary dimensions and angles can be made without departing from the spirit or scope of the disclosed subject matter.

Figure 22:
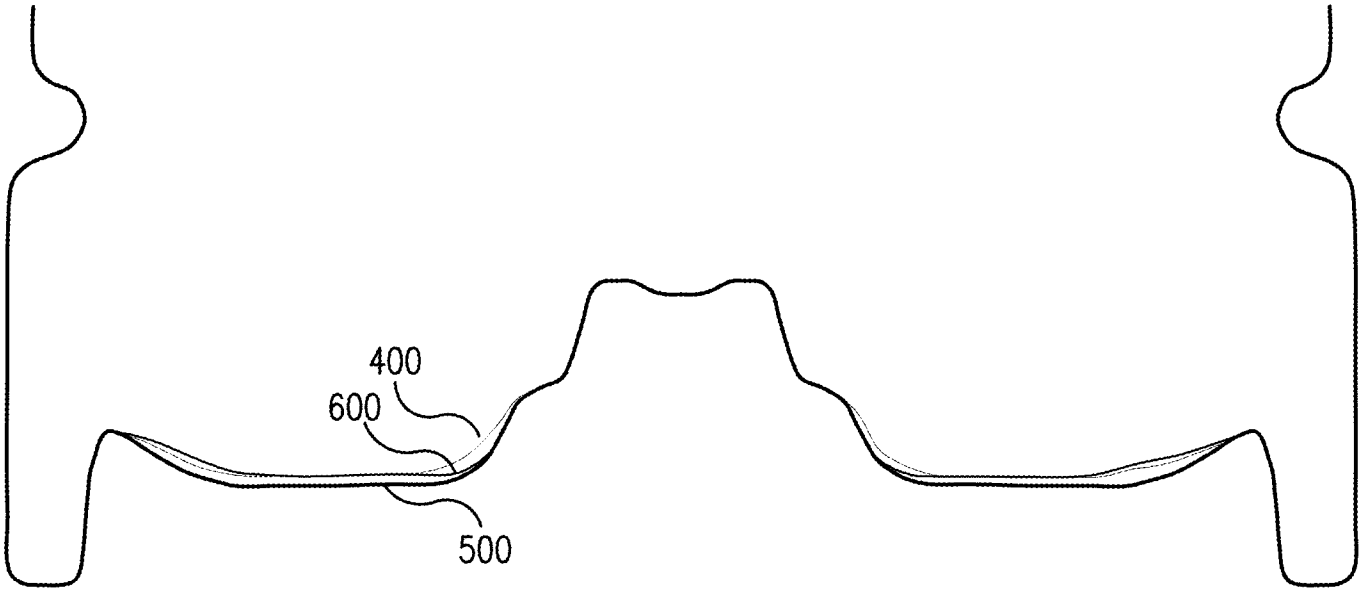
FIG. 22 is a front, cross-sectional schematic view of each of the exemplary embodiments of FIGS. 18-21 overlaid on each other, for purpose of comparison.
Figure 23A:
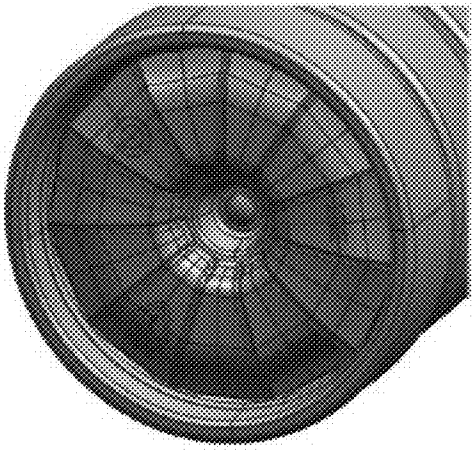
FIGS. 23A-23C each is a bottom perspective view of the exemplary embodiments shown in FIGS. 18-21, shown side-by-side for purpose of comparison.
Figure 23B:
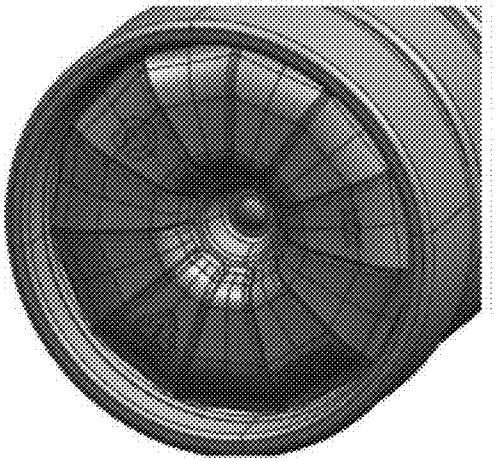
Figure 23C:
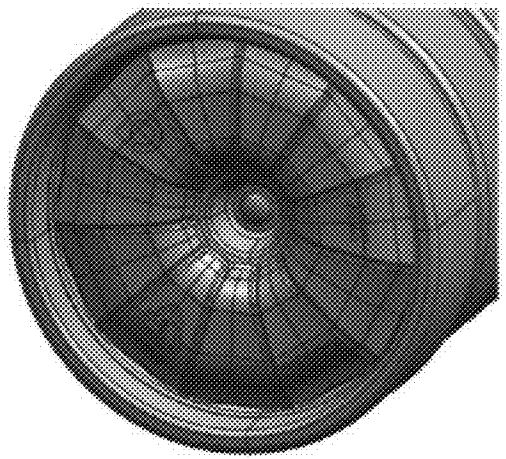

FIG. 22 shows front, cross-sectional schematic views of the exemplary embodiments of FIGS. 18-21 overlaid on each other, for purpose of comparison. FIGS. 23A-23C show bottom perspective views of the exemplary embodiments shown in FIGS. 18-21, shown side-by-side for purpose of comparison. FIG. 23A shows a bottom perspective view of the embodiment of FIG. 21. FIG. 23B shows a bottom perspective view of the embodiment of FIG. 20. FIG. 23C shows a bottom perspective view of the embodiment of FIG. 18.

Figure 24:
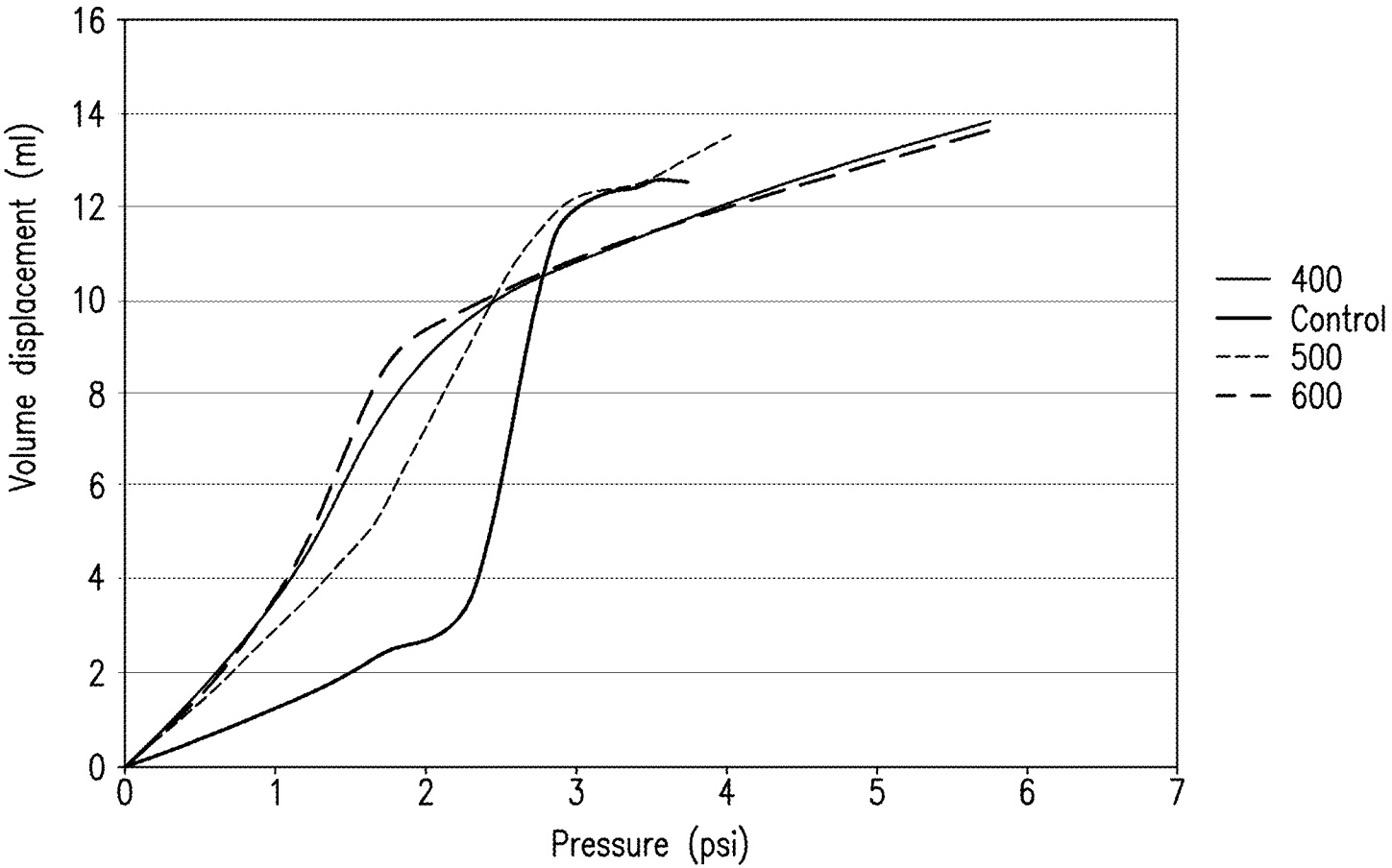
FIG. 24 is a graph illustrating the volume displacement response over a range of pressures for each of the embodiments of FIG. 18, FIG. 20 and FIG. 21 as compared to the known current base of FIG. 12.

FIG. 24 shows a graph illustrating the volume displacement response over a range of pressures for the embodiments of FIG. 18 (ref. 400), FIG. 20 (ref. 500) and FIG. 21 (ref 600) as compared to the known current base of FIG. 12 (ref. Control). FIG. 24 illustrates a simulated volume displacement of each base increasing from an initial reference position over a range of applied vacuum pressure. As shown in FIG. 24, the embodiments of the disclosed subject matter exhibit a relatively uniform, linear displacement under applied vacuum pressure compared to the known current base.

Figure 25:
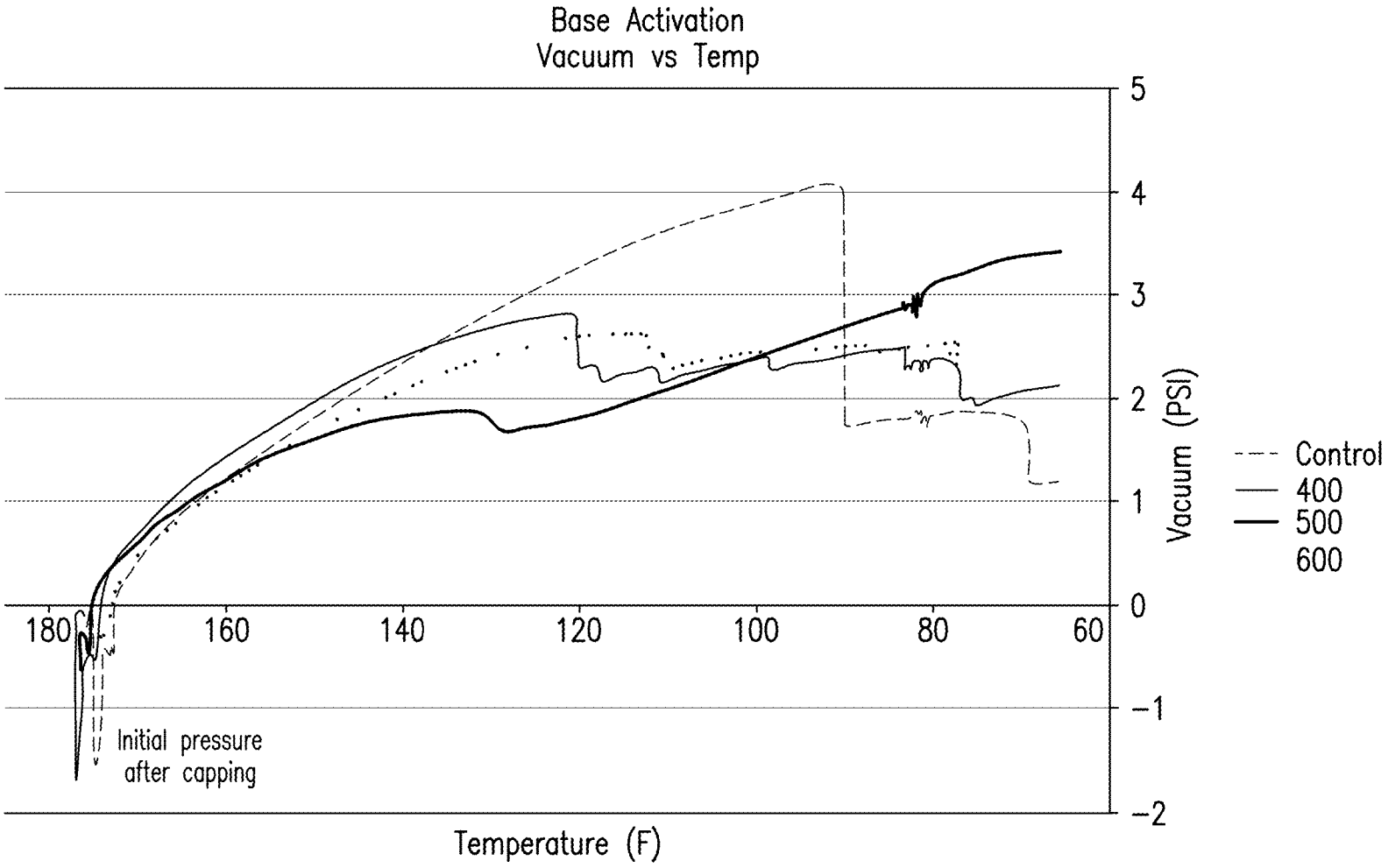
FIG. 25 is a graph of the internal vacuum over a range of decreasing temperatures in a container having bases of each of the embodiments of FIG. 18, FIG. 20, and FIG. 21 as compared to the known current base of FIG. 12.

FIG. 25 shows a graph of the internal vacuum over a range of decreasing temperatures in a container having bases of the embodiments of FIG. 18 (ref. 400), FIG. 20 (ref 500), and FIG. 21 (ref. 600) as compared to the known current base of FIG. 12 (ref. Control). FIG. 25 illustrates relative internal vacuum pressure data measured over a decreasing range of temperatures of the bottles after being filled with hot water and capped. As shown in FIG. 25, the embodiments of the disclosed subject matter generally exhibit a lower internal vacuum pressure due to the cooling of the liquid contents compared to the known current bases. As compared to the discontinuity shown in the current base Control at about 90 degrees F., which can be considered as a base activation point, the embodiments of the disclosed subject matter exhibit a more uniform, linear vacuum pressure in response to the liquid cooling. The base activation points of the exemplary embodiments, shown at about 120 degrees F. in base 400, 130 degrees F. in base 500 and 110 degrees F. in base 600, occur at higher temperatures and result in less discontinuity in the vacuum pressure as compared to the known current base.

In accordance with another aspect of the disclosed subject matter, a further modification is provided of the base for a container as defined above. That is, the base generally, comprises an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the intermediate surface and convex relative to the reference plane, and a central portion disposed proximate the third radiused portion as defined in detail above. As disclosed herein, the base further includes a fourth radiused portion disposed between the support surface and the inner support wall and/or a fifth radiused portion disposed between the support surface and the outer support wall. As with the radiused portions previously defined, the fourth radiused portion and the fifth radiused portion herein each generally functions as a hinge for further deformation of the base. Hence, the portion of the base acting as a diaphragm can extend inwardly from the fourth radiused portion to include the inner support wall or inwardly from the fifth radiused portion to further include the support surface.

Figure 27:
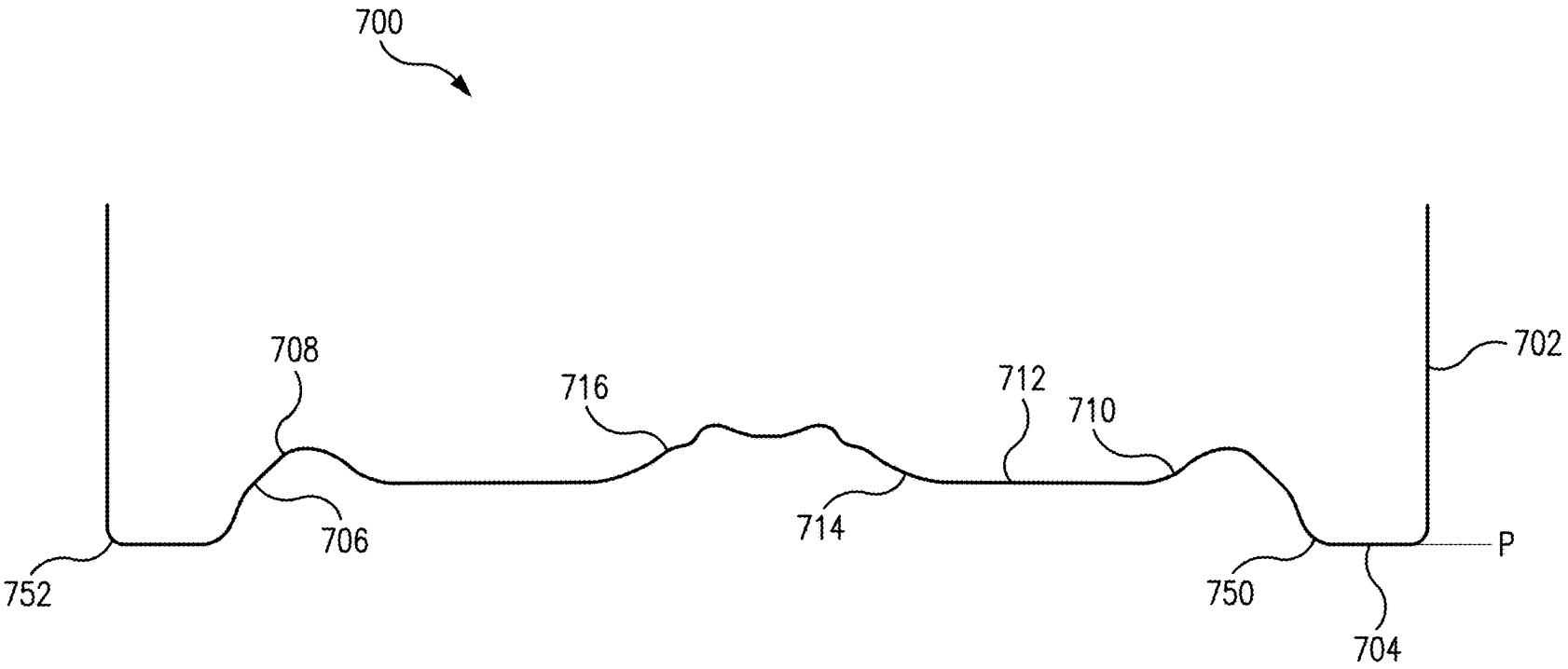
FIG. 27 is a front, cross-sectional schematic view of another exemplary embodiment of a base in accordance with the disclosed subject matter.

For purpose of illustration and not limitation, reference is now made to the exemplary embodiment of FIG. 27. Particularly, FIG. 27 depicts in cross-section the profile of a base 700 having fourth and fifth radiused portions. As depicted in cross-section, the base profile embodied herein generally comprises the various features as described in detail above, including the three radiused portions 708, 710, 714 and intermediate surface 712. Furthermore, a fourth radiused portion 750 is disposed between the support surface 704 and the inner support wall 706 for relative movement therebetween. Additionally or alternatively, a fifth radiused portion 752 can be provided between the support surface 704 and the outer support wall 702. Each of the additional radiused portions can be formed in a variety of ways. As depicted in FIG. 27, the fourth radiused portion 750 is convex when viewed from the bottom, and the inner support wall 706 is configured to extend upward and radially inward from the support surface 704. For example, but not limitation, the inner support wall 706 can be configured such that at least an upper portion thereof extends at an angle of between about 15 degrees and about 85 degrees relative to the reference plane P. Furthermore, and as compared with the embodiment of FIG. 1-3, the support surface 704 can be provided with an increased width in relation to the cross dimension of the base as a whole to enhance the performance of the fifth radiused portion 752 to act as a hinge relative to the outer support wall 702. For example, the support surface 704 can have a width of between about 4% to about 10% of the maximum cross-dimension of the base 700.

In this manner, and as previously described, the radiused portions will function as hinges and can cooperate for dynamic movement of the base as a whole. That is, by providing the fourth radiused portion 750 at the inner edge of the support surface 704, the portion of the base 700 extending inwardly from the fourth radiused portion 750 will act as a diaphragm. Similarly, by providing a fifth radiused portion 752 at the outer support wall 702, the portion of the base 700 extending inwardly from the fifth radiused portion 752 will act as a diaphragm. Depending upon the dimensions of the support surface 704, the diaphragm therefore can comprise at least about 90% of the surface area of the base 700, or even at least about 95% of the surface area.

Furthermore, and as described above, the dimensions and angles of the various features can be selected to tailor the overall performance of the base as desired. For example, the radius and angle of curvature of the various radiused portions, the distances therebetween, and the lengths of the support walls and surfaces can be modified to increase or decrease the spring rate or response to pressure differentials to accommodate a range of thermodynamic environments, such as variations in hot-fill filling lines. Additionally, the angle of curvature of the inner support wall 706 relative to the reference plane P defined by the support surface 704 can be selected for the desired response to pressure differentials to affect the efficiency of the base deformation.

Figure 28:
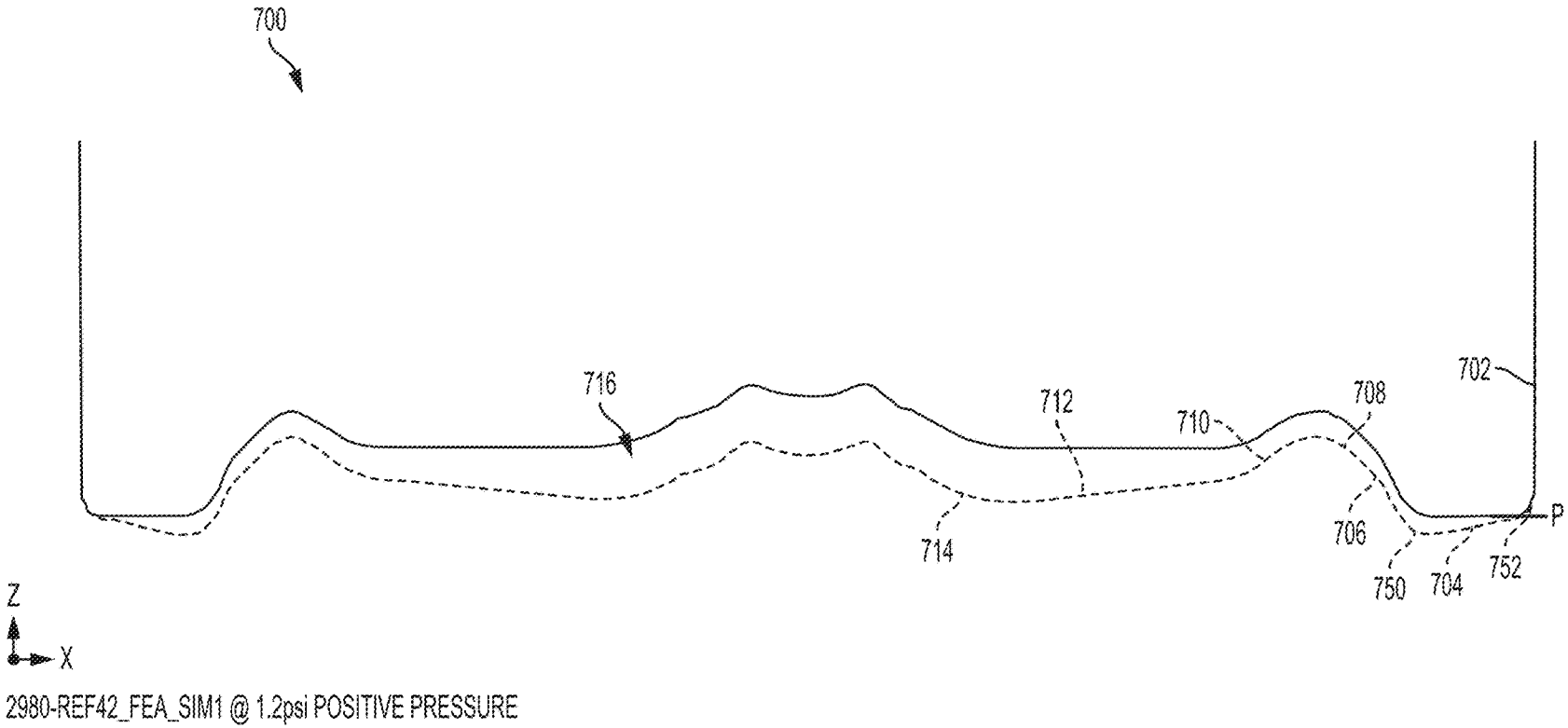
FIG. 28 is a schematic diagram illustrating additional features of the operation of the exemplary embodiment of FIG. 27.
Figure 29:
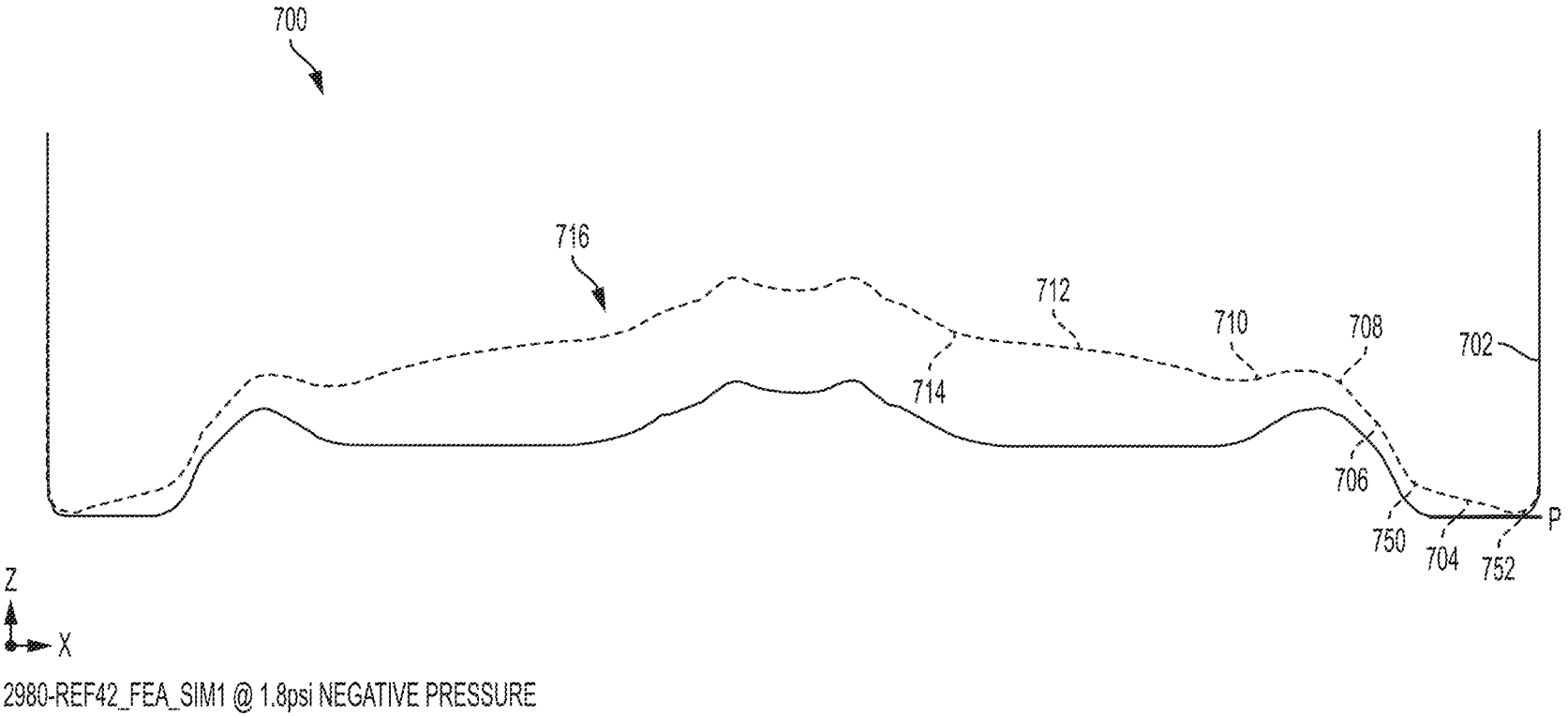
FIG. 29 is a schematic diagram illustrating additional features of the operation of the exemplary embodiment of FIG. 27.

Operation of an exemplary base 700 further having fourth and fifth radiused portions 750, 752 is illustrated schematically with reference to FIGS. 28 and 29. As depicted, operation of base designs having fourth and fifth radiused portions 750, 752 can exhibit base deformation in response to pressure differentials between the container and the environment at the fifth radiused portion 752 proximate the outer wall of the container. Accordingly, in response to a positive pressure differential in the container relative to the environment, the support surface 704 of the base 700 itself can rotate downwards relative to outer support wall 702, and conversely, in response to a negative pressure differential in the container relative to the environment, the support surface 704 can rotate upwards relative to the outer support wall 702.

For example, and as depicted generally in FIG. 28 for purpose of illustration, an increase in pressure within the container will deform the base 700 in a controlled manner such that the fifth radius portion 752 rotates downward relative to the reference plane P (i.e., defined by the support surface when not deflected). That is, and as embodied herein in its initial state, the fifth radiused portion 752 generally defines a right angle or 90° between the support surface 704 and outer support wall 702. Upon an increase in internal pressure, the fifth radiused portion 752 will rotate or open to define an obtuse angle (i.e., greater than 90°). In this manner, as the fifth radiused portion 752 rotates, the standing surface for the container shifts to the inner edge of the support surface 704. As used herein, "standing surface" is the surface that would be in contact with a horizontal surface upon which the base is placed. As shown, however, the radii of the radiused portions 708, 710, 714, 750, 752 and the length of the intermediate surface 712 are selected to cooperate such that the central portion 716 or core does not reside below the standing surface when the maximum desired pressure differential is reached. In a similar fashion, and as shown in FIG. 29, a negative pressure within the container relative the surrounding environment or atmosphere will result in the fifth radiused portion 752 rotating upwardly from the reference plane P to define an acute angle (i.e. less than 90°). As such, the standing surface of the container will shift toward the outer edge of the support surface 704 proximate the outer support wall 702. With reference to the further embodiment disclosed in FIG. 28, the radius portions disposed inwardly of the fifth radius portion 752 can provide additional deformation, which can be approximately 10-20% or more of total base displacement. Hence, and as disclosed herein, the base 700 can be configured such that the support surface 704 can rotate to shift the standing surface toward the inner edge of the support surface 704 proximate the fourth radiused portion 750 when there is a positive pressure differential in the container, and rotate to shift the standing surface to the outer edge of the support surface 704 proximate the fifth radiused portion 752 when there is a negative pressure differential in the container. Throughout operation, the standing surface remains preferably below the remaining portions of the base 700 disposed inwardly of the standing surface.

Particularly, FIGS. 28 and 29 illustrate simulated deformations of base 700 when subject to a range of pressure differentials. FIG. 28 illustrates simulated deformation of base 700 in response to a positive pressures of 1.2 psi. FIG. 29 illustrates simulated deformation of base 700 in response to a negative pressures of 1.8 psi. As shown in FIGS. 28 and 29, the embodiments of the disclosed subject matter exhibit a relatively uniform, linear displacement under applied vacuum pressure compared to the known current base. Additionally, as illustrated, significant displacement occurs at the fifth radiused portion 752, while the portions disposed inwardly of the fourth radiused portion remain 750 above the standing surface.

Figure 30:
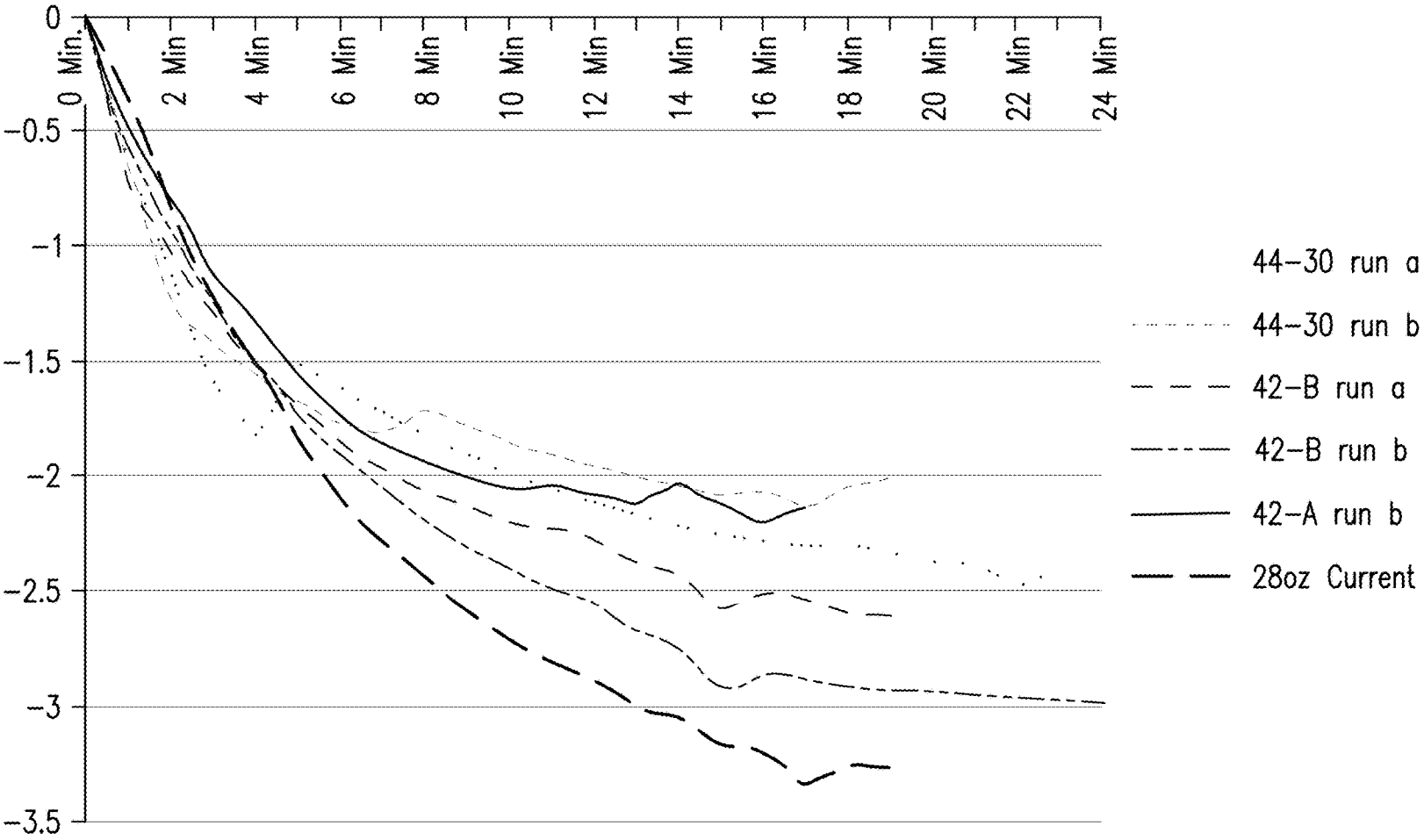
FIG. 30 is a diagram illustrating the rate of volume decrease associated with the decrease in pressure for the containers having a base of the exemplary embodiment of FIG. 27 compared to a container having a base of the exemplary embodiment of FIG. 1.

For purpose of understanding and not limitation, a series of graphs are provided to demonstrate various operational characteristics achieved by the base and container disclosed herein. FIG. 30 shows a graph illustrating the rate of volume decrease associated with the decrease in pressure for the containers having base embodiments as depicted in FIG. 27 compared to a container having a base embodiment as depicted in FIG. 1. Particularly, it is noted that each of the containers was formed of the same materials, dimensions, and processes, and that only the base profiles differ.

In accordance with another aspect of the disclosed subject matter, an alternative base is disclosed herein to achieve controlled deformation at lower pressure differentials than set forth in the prior embodiments. That is, and as with the embodiments previously disclosed, a base is provided having a support surface defining a reference plane, an inner support wall extending upwardly from the support surface, a first radiused portion extending radially inward toward a central longitudinal axis of the base from the inner support wall and concave relative to the reference plane, a second radiused portion extending radially inward toward the longitudinal axis from the first radiused portion and convex relative to the reference plane, an intermediate surface extending radially inward toward the longitudinal axis from the second radiused portion, a third radiused portion extending radially inward toward the longitudinal axis from the intermediate surface and convex relative to the reference plane, a transition portion extending radially inward toward the longitudinal axis from the third radiused portion and being concave relative to the reference plane, and a central portion disposed proximate the third radiused portion. As disclosed herein, the intermediate surface can comprise a linear portion extending radially from the second radiused portion, and an intermediate radiused portion extending radially inward from the linear portion and concave relative to the reference plane. Furthermore, the linear portion of the intermediate surface can be substantially parallel with the reference plane.

With reference to FIGS. 31-34, for purpose of illustration and not limitation, the base 800 disclosed herein generally defines a diaphragm including a series of radiused portions. For example and as shown for example in FIG. 31, the base 800 generally can include a support surface 804 extending inwardly from the outer support wall 802 and defining a reference plane P8, and an inner support wall 806 extending upwardly from the support surface 804. In accordance with the disclosed subject matter, a first radiused portion 808 extends radially inward from the inner support wall 806 and concave relative to the reference plane P8. A second radiused portion 810 extends radially inward from the first radiused portion 808 and convex relative to the reference plane P8. An intermediate surface 812 extends radially inward from the second radiused portion 810. A third internal radiused portion 814 extends radially inward from the intermediate surface 812 and convex to the reference plane P8 to a central portion 816. In accordance with the disclosed subject matter, the intermediate surface 812 can comprise a linear portion 811 extending radially from the second radiused portion 810, and an intermediate radiused portion 813 extending radially inward from the linear portion 811 and concave relative to the reference plane. The linear portion 811 of the intermediate surface 812 can extend at an angle substantially parallel (i.e., +/−10 degrees) relative to the reference plane P8. Likewise, the intermediate radiused portion can have a radius between about 0.030 inches and about 0.100 inches.

As described above, the various radiused portions generally function as hinges to control at least in part the dynamic movement of the base 800. For example, the intermediate radiused portion 813 and the third radiused portion 814 can be configured as the primary contributors to the initial deflection of the base, while the first radiused portion 808 can act as the primary contributor to the total amount of base deformation. With reference to the exemplary embodiment disclosed in FIG. 31, and as further shown and described below, the intermediate radiused portion 813 of the intermediate surface 812 can be configured to increase base movement at lower vacuum pressure differentials.

Furthermore, and as previously set forth, each radiused portion can be configured to deform in conjunction with the other. For example, a change to the geometry and/or relative location of the third radiused portion 814 can affect the deformation response of the intermediate radiused portion 813, which can also affect the deformation response of the first radiused portion 808. Additionally, the length and configuration of the linear portion and the intermediate radiused portion of the intermediate surface 812 can be selected to affect such deformation based upon its relationship with the second and the third radiused portions 810, 814. Likewise, the transition portion 826 extending radially inward from the third radiused portion 814 can also be configured to affect the efficiency or response of the base deformation. In this manner, a diaphragm can be designed and tailored based upon these interactions to provide a desired performance and effect, such as by providing increased base movement at lower internal vacuum pressures.

Additionally, and as previously noted, the base 800 can include a central portion. For example, again with reference to FIG. 31, for illustration and not limitation, the central portion 816 can be configured to form a variety of suitable shapes and profiles. For example, and as depicted, the central portion 816 can be provided with an inner core 818. The inner core 818 can have a generally frustoconical shape or the like and can be shallow or deep as desired. By way of example, the inner core 818 can comprise a sidewall 820 and a top surface 822 extending from the sidewall 820, the top surface 822 having a convex portion 824 relative to the reference plane P8. In addition to the profile of the base 800 as defined by the radiused portion locations, the radius of the transition portion 826 between the central portion 816 and the third radiused portion 814, as well as the conical shape of the inner core 818, can be modified to increase or decrease the spring rate or response to pressure differentials, which can accommodate a range of thermodynamic environments, such as variations in hot-fill filling lines. The base profile can also allow the base 800 to be scaled to containers of different overall shapes such as oval, square or rectangular shapes and different sizes while maintaining consistent thermal and pressure performance characteristics.

For example, but not limitation, and again with reference to FIG. 31, as depicted in cross-section, the base generally comprises the various features as described in detail above, including the three radiused portions 808, 810, 814, an intermediate surface, which comprises a linear part 811 and the intermediate radiused portion 813 as further disclosed herein. Furthermore, a fourth radiused portion 850 can be disposed between the support surface 804 and the inner support wall 806 for relative movement therebetween as previously set forth. Additionally or alternatively, a fifth radiused portion 852 can be provided between the support surface 804 and the outer support wall 802 as previously set forth. In this manner, and as previously described, the radiused portions will function as hinges and can cooperate for dynamic movement of the base as a whole. That is, by providing the fourth radiused portion 850 at the inner edge of the support surface 804, the portion of the base 800 extending inwardly from the fourth radiused portion 850 will act as a diaphragm. Similarly, by providing a fifth radiused portion 852 at the outer support wall 802, the portion of the base 800 extending inwardly from the fifth radiused portion 852 will act as a diaphragm.

As previously set forth, particularly at lower pressure differentials, the overall design and contour of the base profile, or a portion thereof, can act as a diaphragm responsive to negative internal pressure or vacuum as well as positive internal pressure. The diaphragm can aid in concentrating and distributing axial stress. With reference to the exemplary embodiment of FIG. 31-34, the effective area of the diaphragm can be measured as the portion of the base extending diametrically from the top of the inner support wall 806 on one side of the container to the top of the inner support wall 806 on the opposite side. The differential in pressure between the inside of the container and outside of the container can flex the base 800 in a controlled manner. The concentration of stress can be rapidly distributed to radiate outwardly from the center of the base 800 in a uniform circumferential manner. The stress concentrations in the base thus can be directed circumferentially at or around the radiused portions in the diaphragm plane and extend out in a wave manner.

Figure 31:
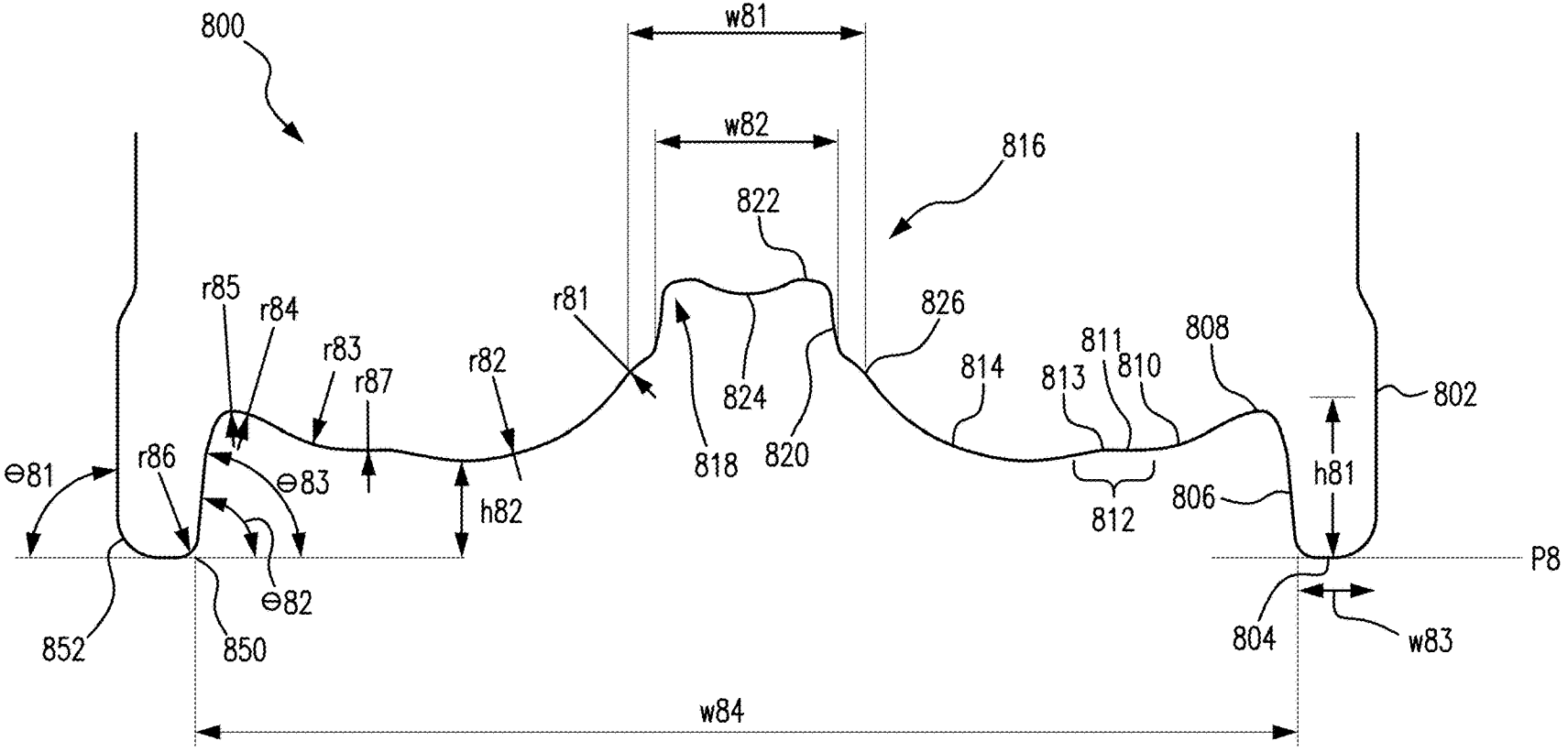
FIG. 31 is a front, cross-sectional schematic view of an exemplary embodiment of a base in accordance with another aspect of the disclosed subject matter, including an intermediate surface having a linear portion and an intermediate radiused portion.
Figure 32B:
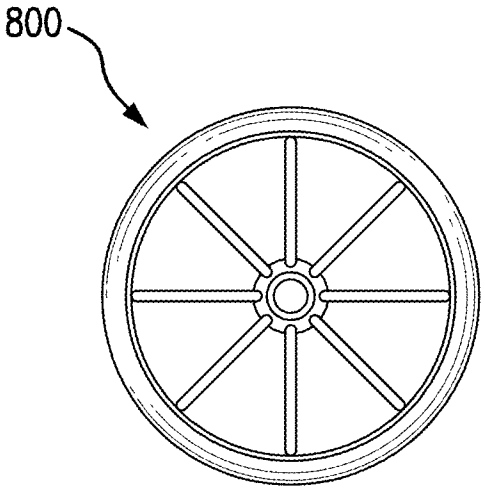
FIG. 32B is a bottom plan view of the exemplary embodiment of FIG. 31.
Figure 32A:
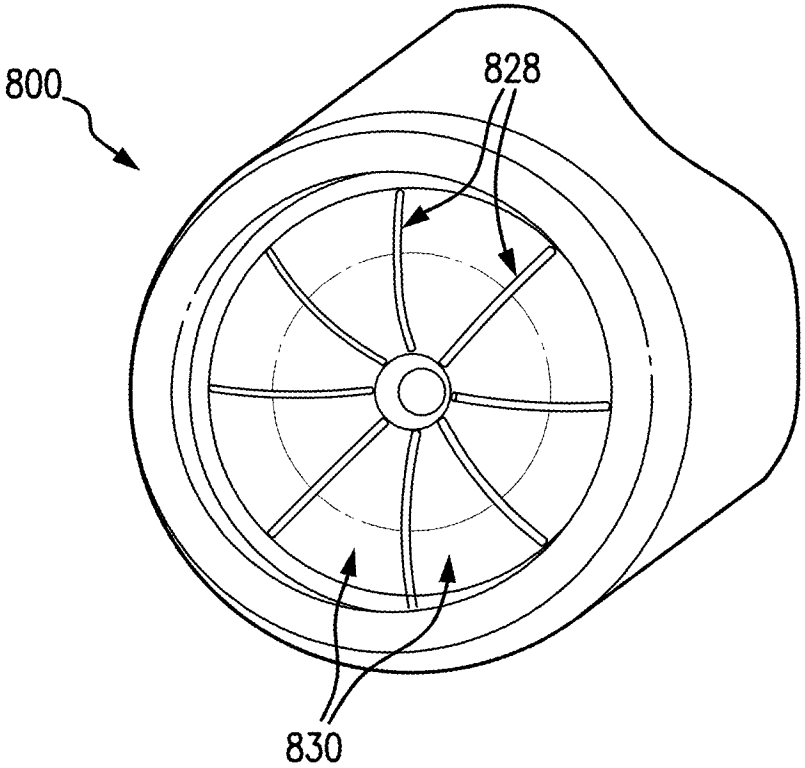
FIG. 32A is a bottom left perspective view of the exemplary embodiment of FIG. 31.

FIG. 32A shows a bottom right perspective view of the exemplary embodiment of FIG. 31. FIG. 32B shows a bottom plan view of the exemplary embodiment of FIG. 31. With reference to FIGS. 32A-B, the base design 800 can further include ribs 828 to form base segments 830 that can cooperate with the radial radiused portions to improve strength and resistance to deformation or roll out from positive pressure within the container as previously set forth above. In FIGS. 32A-B, the base 800 generally can include any number of radial segments between the radiused portions to proportionally distribute the force differential between the inside and outside of the container to provide a low spring rate.

The geometry of the ribs 828 that define the segments 830 can provide support to the base 800 as it radiates out toward the support surface 804. In this manner, and as described with reference to the other exemplary embodiments above, each segment 830, if provided, can be formed as a wedge and can serve as a discrete segment of the base.

As embodied herein, each segment can have a profile that matches the base profile of FIG. 31 when viewed in corresponding cross-sectional profile. Furthermore, and as previously disclosed, the transverse cross section of each segment as it extends radially out from the center longitudinal axis, can have a convex or concave shape relative to the reference plane P8. A segment 830 that is convex-shaped in transverse cross-section when referring to the reference plane P8 can create small regions that can invert displacing volume in the presence of vacuum. As such, volume displacement can be reduced relative to the entire base or diaphragm structure movement. A segment 830 that is concave-shaped relative to the reference plane P can improve control of deformation from internal pressure. The concave shape can further control total base movement. The ribs 828 dividing the base 800 can further support or tie the base together circumferentially. The ribs 828 can be formed continuously along the base 800 from the inner core 818 to the support surface 804. Alternatively, the ribs 828 can be formed with discontinuities, for example having discontinuities along the base 800 at the points where any or all of the radiused portions are formed. In addition, the rib cross section can have varying shapes and sizes.

The base segments 830 can each function independently to provide variable movement of the base 800 and can result in displacement in response to small changes in internal or external changes in container pressure. The combined structure of the individual segments 830 and the ribs 828 dividing the segments 830 can reduce the reaction or displacement to positive pressure while increasing or maintaining sensitivity to negative internal pressure. The base segments 830 can move independently in response to the force or rate of pressure change. Thus, each base segment 830 or area within the segment can provide a secondary finite response to vacuum deformation and product displacement. As such, the combination of segments 830 and dividing ribs 828 can adapt or compensate to variations in wall thicknesses and gate locations among containers formed using base 800 that would otherwise cause inconsistent or incomplete base movement as found in the control. The movement of the segments can be secondary to primary movement or deflection of the overall base diaphragm structure, which can be affected by the base geometry and radiused portions, as described herein.

Figure 33:
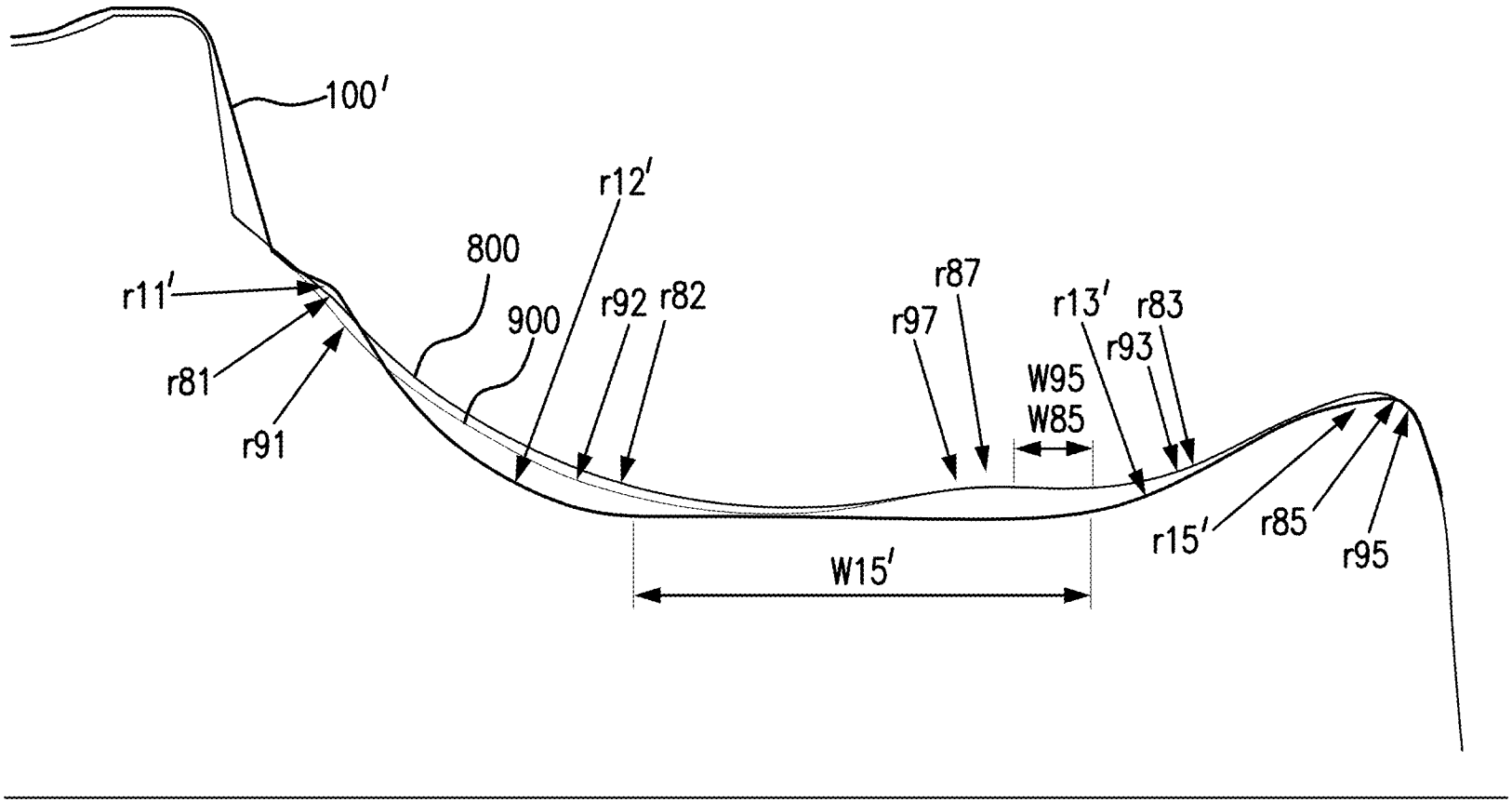
FIG. 33 is a comparative front, cross-sectional schematic view of the exemplary embodiment of FIG. 1 overlaid with two alternative embodiments of a base of the disclosed subject matter including an intermediate surface having a linear portion and an intermediate radiused portion.

For purpose of comparison and not limitation, FIG. 33 shows a front, cross-sectional schematic view of a base having the same configuration as the exemplary embodiment previously described with reference to FIG. 1 (ref. 100'), along with two alternate embodiments (refs. 800, 900) of a base having an intermediate surface including a linear portion and an intermediate radiused portion. That is, each of the embodiments of refs. 800 and 900 respectively include a base having a support surface defining a reference plane, an inner support wall extending upwardly from the support surface, a first radiused portion extending radially inward toward a central longitudinal axis of the base from the inner support wall and concave relative to the reference plane, a second radiused portion extending radially inward toward the longitudinal axis from the first radiused portion and convex relative to the reference plane, an intermediate surface extending radially inward toward the longitudinal axis from the second radiused portion, a third radiused portion extending radially inward toward the longitudinal axis from the intermediate surface and convex relative to the reference plane, a transition portion extending radially inward toward the longitudinal axis from the third radiused portion and being concave relative to the reference plane, and a central portion disposed proximate the third radiused portion. Furthermore, each of the bases shown in cross-sectional schematic view in FIG. 33 (base 100', base 800, and base 900) was made of the same material, and substantially the same dimensions and weight. However, because of the different base configurations (i.e. intermediate surface configurations), each base has a different response profile as set forth below with reference to FIG. 34.

For purpose of comparison and not limitation, exemplary dimensions and angles of the bases shown in FIG. 33 are provided in Table 2. As shown, the radius of curvature r92 of the third radiused portion of the embodiment of ref. 900 is larger as compared to the radius of curvature r82 of the third radiused portion of the embodiment of ref. 800. Further, the radius of curvature r97 of the intermediate radiused portion of the embodiment of ref. 900 is relatively larger as compared to the radius of curvature r87 of the intermediate radiused portion of the embodiment of ref 800. By comparison, the base 100' does not include an intermediate radiused portion. As described above, and further shown by the results in FIG. 33, these dimensions can be tailored to provide a desired performance and effect of the base. For example, lighter weight blow molded plastic containers with thinner wall thicknesses can benefit from base configurations similar to ref 800 or 900 due to the greater controlled deformation at lower pressure differentials, as compared to a container of similar size and shape but greater weight and wall thickness.

Figure 34:
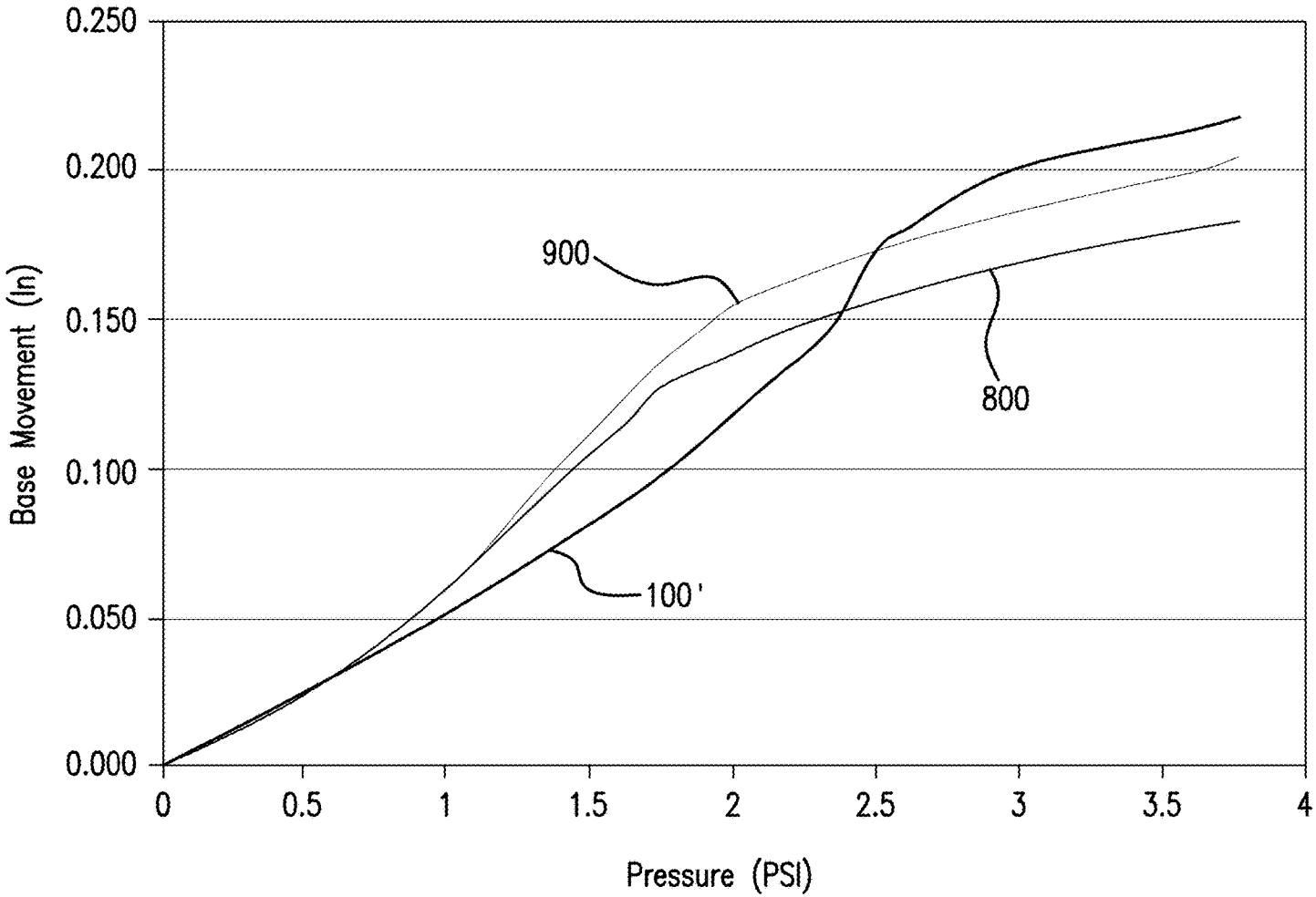
FIG. 34 is a comparative graph illustrating the base movement response over a range of pressures for a container having each of the embodiments of FIG. 33.

For purpose of understanding and not limitation, a series of graphs are provided to demonstrate various operational characteristics achieved by the base and container disclosed herein. FIG. 34 shows a graph illustrating the vertical base movement response over a range of pressures for various embodiments of FIG. 33. That is, the graph illustrates the vertical base movement for two alternate embodiments of a base having an intermediate surface with a linear portion and an intermediate radiused portion, as depicted in ref 800 and 900, as compared to the vertical base movement of a base having an intermediate surface as depicted by ref. 100'. Each of the container having base 800, the container having base 900, and the container having base 100' were formed of the same materials, with substantially the same weights and wall thicknesses, wherein only the base profiles differ as depicted in FIG. 33.

FIG. 34 illustrates a simulated volume displacement of each base increasing from an initial reference position over a range of applied vacuum pressure. As shown by the results of FIG. 34, the embodiments having an intermediate surface with an intermediate radiused portion (ref. 800, ref. 900) exhibit increased volume displacement under lower applied internal vacuum pressure as compared to ref. 100'. This greater response to lower vacuum pressure allows controlled deformation of the base for containers of lower weight before undesirable deformation in other areas of the container (such as the container sidewall). This controlled deformation allows the remaining bottle structure to retain its shape while being subjected to the internal pressures exerted during the hot-fill and capping process, and the cooling process.

It will be apparent to those skilled in the art that various modifications and variations to the exemplary dimensions and angles can be made without departing from the spirit or scope of the disclosed subject matter. For example, and as described above, the specific dimensions and angles of the base configuration disclosed herein can be selected to tailor the overall performance of the base as desired. For example, the radius and angle of curvature of the various radiused portions, the distances therebetween, and the lengths of the support walls and surfaces can be modified to increase or decrease the spring rate or response to pressure differentials to accommodate a range of thermodynamic environments, such as variations in hot-fill filling lines. Additionally, the angle of curvature of the inner support wall 806 relative to the reference plane P8 defined by the support surface 804 can be selected for the desired response to pressure differentials to affect the efficiency of the base deformation.

In accordance with another aspect of the disclosed subject matter, a container is provided having a base as described in detail above. The container generally comprises a sidewall and a base, the base comprising an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion, a third radiused portion extending radially inward from the intermediate surface and convex relative to the reference plane, and a central portion disposed proximate the third radiused portion. The intermediate surface can at least include a linear portion extending radially from the second radiused portion. Additionally, and in accordance with another aspect of the disclosed subject matter as set forth above, the intermediate surface can include an intermediate radiused portion extending radially inward from the linear portion and concave relative to the reference plane. As embodied herein, the container sidewall can be coextensive and/or integral with the outer support wall of the base. Other modifications and feature as described in detail above or otherwise known can also be employed.

The various embodiments of the base and of the container as disclosed herein can be formed by conventional molding techniques as known in the industry. For example, the base can be formed by blow-molding with or without a movable cylinder.

In addition to the specific embodiments claimed below, the disclosed subject matter is also directed to other embodiments having any other possible combination of the dependent features claimed below and those disclosed above. As such, the particular features disclosed herein can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

TABLE 1

| Exemplary Dimensions | |
|---|---|
| Dimension | Length in Inches (Millimeters) |
| h11 | 0.318 (8.09) |
| h12 | 0.228 (5.78) |
| h13 | 0.328 (8.34) |
| w11 | 0.633 (16.08) |
| w12 | 0.468 (11.90) |
| w13 | 0.062 (1.57) |
| w14 | 2.575 (65.41) |
| w15 | 0.270 (6.85) |
| h21 | 0.199 (5.06) |
| h22 | 0.504 (12.80) |
| h23 | 0.108 (2.73) |
| h24 | 0.207 (5.27) |
| w21 | 0.607 (15.42) |
| w22 | 0.488 (11.90) |
| w23 | 0.062 (1.57) |
| w24 | 0.278 (7.06) |
| w25 | 2.591 (65.81) |
| h31 | 0.206 (5.24) |
| h32 | 0.306 (7.77) |
| w31 | 0.801 (20.34) |
| w32 | 0.714 (19.14) |

TABLE 1-continued

| Exemplary Dimensions | |
|---|---|
| w33 | 0.606 (15.38) |
| w34 | 0.062 (1.57) |
| w35 | 0.040 (1.02) |
| w36 | 0.094 (2.38) |
| w37 | 0.270 (6.85) |
| w38 | 0.040 (1.02) |
| w39 | 0.029 (0.74) |
| w310 | 0.045 (1.14) |
| w311 | 2.575 (65.41) |
| h41 | 0.311 (7.91) |
| h42 | 0.219 (5.57) |
| h43 | 0.320 (8.12) |
| w41 | 0.633 (16.07) |
| w42 | 0.468 (11.90) |
| w43 | 0.062 (1.57) |
| w44 | 2.441 (62.01) |
| w45 | 0.278 (7.06) |
| h51 | 0.199 (5.06) |
| h52 | 0.320 (8.12) |
| w51 | 0.629 (15.97) |
| w52 | 0.468 (11.90) |
| w53 | 0.062 (1.57) |
| w54 | 2.441 (62.01) |
| w55 | 0.328 (8.33) |
| h61 | 0.219 (5.57) |
| h62 | 0.320 (8.12) |
| w61 | 0.629 (15.97) |
| w62 | 0.468 (11.90) |
| w63 | 0.062 (1.57) |
| w64 | 2.441 (62.01) |
| w65 | 0.328 (8.34) |
| Dimension | Radius of Curvature in Inches (Millimeters) |
| r11 | 0.060 (1.52) |
| r12 | 0.368 (9.36) |
| r13 | 0.358 (9.09) |
| r14 | 0.347 (8.81) |
| r15 | 0.040 (1.02) |
| r16 | 0.041 (1.03) |
| r21 | 0.420 (10.68) |
| r22 | 0.357 (9.08) |
| r23 | 0.039 (1.00) |
| r24 | 0.100 (2.54) |
| r25 | 0.388 (9.35) |
| r26 | 0.357 (9.08) |
| r27 | 0.420 (10.68) |
| r28 | 0.040 (1.02) |
| r31 | 0.100 (2.54) |
| r32 | 0.138 (3.51) |
| r33 | 0.403 (10.23) |
| r34 | 0.357 (9.08) |
| r35 | 0.060 (1.52) |
| r36 | 0.040 (1.02) |
| r41 | 0.060 (1.52) |
| r42 | 0.224 (5.70) |
| r43 | 0.358 (9.09) |
| r44 | 0.352 (8.94) |
| r45 | 0.040 (1.02) |
| r46 | 0.041 (1.03) |
| r51 | 0.060 (1.52) |
| r52 | 0.154 (3.90) |
| r53 | 0.358 (9.09) |
| r54 | 0.182 (4.61) |
| r55 | 0.040 (1.02) |
| r56 | 0.041 (1.03) |
| r61 | 0.060 (1.52) |
| r62 | 0.119 (3.03) |
| r63 | 0.358 (9.09) |
| r64 | 0.541 (13.75) |
| r65 | 0.040 (1.02) |
| r66 | 0.041 (1.03) |

TABLE 1-continued

| Exemplary Dimensions | |
|---|---|
| Angle | Degrees |
| θ11 | 90 |
| θ12 | 85 |
| θ13 | 70 |
| θ21 | 90 |
| θ22 | 74 |
| θ23 | 20 |
| θ31 | 90 |
| θ32 | 20 |
| θ41 | 90 |
| θ42 | 85 |
| θ43 | 70 |
| θ51 | 90 |
| θ52 | 85 |
| θ53 | 70 |
| θ61 | 90 |
| θ62 | 85 |
| θ63 | 70 |

TABLE 2

| Exemplary Dimensions of Alternate Embodiments | |
|---|---|
| Dimension | Length in Inches (Millimeters) |
| h81 | 0.320 (8.13) |
| h82 | 0.220 (5.59) |
| w15' | 0.291 (7.39) |
| w81 | 0.516 (13.12) |
| w82 | 0.401 (10.19) |
| w83 | 0.055 (1.40) |
| w84 | 2.457 (62.40) |
| w85 | 0.300 (7.62) |
| w95 | 0.300 (7.62) |
| Dimension | Radius of Curvature in Inches (Millimeters) |
| r11' | 0.020 (0.51) |
| r12' | 0.258 (6.55) |
| r13' | 0.358 (9.09) |
| r15' | 0.040 (1.02) |
| r81 | 0.120 (3.05) |
| r82 | 0.445 (11.31) |
| r83 | 0.315 (8.00) |
| r84 | 0.350 (8.90) |
| r85 | 0.040 (1.02) |
| r86 | 0.040 (1.02) |
| r87 | 0.400 (10.16) |
| r91 | 0.100 (2.54) |
| r92 | 0.505 (12.81) |
| r93 | 0.315 (8.00) |
| r95 | 0.040 (1.02) |
| r97 | 0.040 (10.16) |
| Angle | Degrees |
| θ81 | 90 |
| θ82 | 85 |
| θ83 | 70 |

The invention claimed is:

1. A base for a blow-molded container, the base as formed comprising:

a support surface defining a reference plane;

an inner support wall extending upwardly from the support surface;

a first radiused portion extending radially inward toward a central longitudinal axis of the base from the inner support wall and concave relative to the reference plane;

a second radiused portion extending radially inward toward the longitudinal axis from the first radiused portion and convex relative to the reference plane;

an intermediate surface extending radially inward toward the longitudinal axis from the second radiused portion, wherein the intermediate surface comprises an intermediate radiused portion concave relative to the reference plane;

a third radiused portion extending radially inward toward the longitudinal axis from the intermediate surface and convex relative to the reference plane;

a transition portion extending radially inward toward the longitudinal axis from the third radiused portion and being concave relative to the reference plane; and a central portion disposed proximate the transition portion.

2. The base of claim 1, wherein the intermediate surface further comprises a linear portion extending radially from the second radiused portion to the intermediate radiused portion.

3. The base of claim 2, wherein the linear portion of the intermediate surface is substantially parallel with the reference plane.

4. The base of claim 1, wherein the central portion includes an inner core, the inner core comprising a sidewall.

5. The base of claim 4, the sidewall of the inner core extending at an angle from the transition portion.

6. The base of claim 5, wherein the inner core further comprises a top surface extending from the sidewall, the top surface having a convex portion relative the reference plane.

7. The base of claim 1, further comprising a fourth radiused portion disposed between the support surface and the inner support wall.

8. The base of claim 7, wherein a diaphragm is defined inwardly from the fourth radiused portion.

9. The base of claim 8, wherein the diaphragm comprises at least about 90% of the surface area of the base.

10. The base of claim 7, further comprising a fifth radiused portion disposed between the support surface and an upwardly-extending outer support wall.

11. The base of claim 10, wherein a diaphragm is defined inwardly toward the longitudinal axis from the fifth radiused portion.

12. The base of claim 11, wherein the diaphragm comprises about 95% of the surface area of the base.

13. The base of claim 1, further comprising a plurality of ribs extending from the central portion toward the support surface and spaced circumferentially apart to define a plurality of base segments between the central portion and the support surface in plan view.

14. The base of claim 13, wherein each of the base segments is configured to deform independently with respect to an adjacent base segment.

15. A blow-molded container as formed comprising: a sidewall including an upper end having a finish portion and a lower end opposite the upper end; and a base extending from the lower end, the base comprising:

a support surface defining a reference plane, an inner support wall extending upwardly from the support surface, a first radiused portion extending radially inward toward a central longitudinal axis of the base from the inner support wall and concave relative to the reference plane, a second radiused portion extending radially inward toward the longitudinal axis from the first radiused portion and convex relative to the reference plane, an intermediate surface extending radially inward toward the longitudinal axis from the second radiused portion, wherein the intermediate surface comprises an intermediate radiused portion concave relative to the reference plane, a third radiused portion extending radially inward toward the longitudinal axis from the intermediate surface and convex relative to the reference plane, a transition portion extending radially inward toward the longitudinal axis from the third radiused portion and being concave relative to the reference plane, and a central portion disposed proximate the transition portion.

16. The container of claim 15, wherein the intermediate surface further comprises a linear portion extending radially from the second radiused portion to the intermediate radiused portion.

17. The container of claim 16, wherein the linear portion of the intermediate surface is substantially parallel with the reference plane.

18. The container of claim 15, wherein the central portion includes an inner core, the inner core comprising a sidewall extending at an angle from the transition portion.

19. The container of claim 15, further comprising a plurality of ribs extending from the central portion toward the support surface and spaced circumferentially apart to define a plurality of base segments between the central portion and the support surface in plan view, wherein each of the base segments is configured to deform independently with respect to an adjacent base segment.

* * * * *